US011633971B2

(12) United States Patent
Sasaki et al.

(10) Patent No.: US 11,633,971 B2
(45) Date of Patent: Apr. 25, 2023

(54) RIBBON REELING MECHANISM AND TAPE PRINTING APPARATUS

(71) Applicant: SEIKO EPSON CORPORATION, Tokyo (JP)

(72) Inventors: Taishi Sasaki, Matsumoto (JP); Kenichi Nakajima, Shimosuwa-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 139 days.

(21) Appl. No.: 17/371,684

(22) Filed: Jul. 9, 2021

(65) Prior Publication Data

US 2022/0009257 A1 Jan. 13, 2022

(30) Foreign Application Priority Data

Jul. 10, 2020 (JP) ..... JP2020-119415

(51) Int. Cl.
*B41J 33/22* (2006.01)
*B41J 2/325* (2006.01)
*B41J 3/407* (2006.01)

(52) U.S. Cl.
CPC ..... *B41J 33/22* (2013.01); *B41J 2/325* (2013.01); *B41J 3/4075* (2013.01)

(58) Field of Classification Search
CPC . B41J 33/22; B41J 2/325; B41J 3/4075; B41J 2/32; B41J 2/315; B41F 16/00; B41F 16/0006; B41F 16/0026; B41F 16/0033
See application file for complete search history.

(56) References Cited

U.S. PATENT DOCUMENTS

2009/0162125 A1* 6/2009 Kubota ..... B41J 3/4075 400/611
2018/0022110 A1 1/2018 Sasaki
2018/0264844 A1 9/2018 Sasaki

FOREIGN PATENT DOCUMENTS

JP 2016-144875 A 8/2016
JP 2018140644 * 9/2018 ..... B41J 33/51
JP 2019209556 * 12/2019 ..... B41J 17/08

* cited by examiner

*Primary Examiner* — Kristal Feggins
(74) *Attorney, Agent, or Firm* — Oliff PLC

(57) ABSTRACT

A ribbon reeling mechanism includes: a gear supporting member that supports a clutch gear rotatably and is configured to move between a mesh position at which the clutch gear supported by the gear supporting member is in mesh with a first reeling-side gear and a non-mesh position at which the clutch gear supported by the gear supporting member is not in mesh with the first reeling-side gear; a clutch impeding spring that causes a clutch impeding force of impeding movement from the mesh position to the non-mesh position to act on the gear supporting member when a feed motor starts rotating in the second rotation direction; a drive member engaged with the gear supporting member; and a clutch drive mechanism that causes the gear supporting member to move to the non-mesh position against the clutch impeding force when the feed motor rotates in the second rotation direction.

7 Claims, 14 Drawing Sheets

RIBBON REELING MECHANISM AND TAPE PRINTING APPARATUS

The present application is based on, and claims priority from JP Application Serial Number 2020-119415, filed Jul. 10, 2020, the disclosure of which is hereby incorporated by reference herein in its entirety.

BACKGROUND

1. Technical Field

Embodiments of the present disclosure relate to a ribbon reeling mechanism capable of reeling and rewinding an ink ribbon, and to a tape printing apparatus.

2. Related Art

In related art, as disclosed in JP-A-2016-144875, a tape printing apparatus capable of reeling and rewinding an ink ribbon is known. The tape printing apparatus includes a gear train that includes a planet gear and a reeling-side input gear. The planet gear meshes with the reeling-side input gear when a drive motor is driven to rotate in the forward direction. Therefore, the rotation of the drive motor is transmitted to a reeling-side drive shaft so that the ink ribbon will be reeled onto a ribbon reeling core. The planet gear is disengaged from the reeling-side input gear when the drive motor is driven to rotate in the reverse direction. Because of the disengagement, the rotation of the drive motor is not transmitted to the reeling-side drive shaft. A tension spring that limits a torque transmitted from a reeling-side output gear to the reeling-side drive shaft is provided between the reeling-side output gear and the reeling-side drive shaft.

In the tape printing apparatus according to related art, there is a risk that the planet gear might not become disengaged from the reeling-side input gear due to the elastic force of the tension spring until the elastic deformation of the tension spring is removed by rotation of the reeling-side output gear to some extent when the rewinding of the ink ribbon starts. If this happens, the ink ribbon will be rewound while being tensioned excessively by the elastic force of the tension spring until the planet gear becomes disengaged from the reeling-side input gear. This technical issue needs to be solved.

SUMMARY

A ribbon reeling mechanism according to a certain aspect of the present disclosure includes: an unreeling rotor engaged with an unreeling core around which an ink ribbon is wound; a reeling rotor engaged with a reeling core onto which the ink ribbon reeled out from the unreeling core is reeled; a feed motor that is rotatable in a first rotation direction and a second rotation direction, the second rotation direction being opposite of the first rotation direction; a reeling-side gear train that includes a first reeling-side gear and a clutch gear, the clutch gear being configured to move between a position at which the clutch gear is in mesh with the first reeling-side gear and a position at which the clutch gear is not in mesh with the first reeling-side gear, the reeling-side gear train being configured to transmit rotation of the feed motor to the reeling rotor so as to reel the ink ribbon onto the reeling core by meshing engagement of the clutch gear with the first reeling-side gear when the feed motor rotates in the first rotation direction, the reeling-side gear train being configured not to transmit the rotation of the feed motor to the reeling rotor by disengagement of the clutch gear from the first reeling-side gear when the feed motor rotates in the second rotation direction; an unreeling-side gear train that does not transmit the rotation of the feed motor to the unreeling rotor when the feed motor rotates in the first rotation direction and transmits the rotation of the feed motor to the unreeling rotor so as to rewind the ink ribbon onto the unreeling core when the feed motor rotates in the second rotation direction; a gear supporting member that supports the clutch gear rotatably and is configured to move between a mesh position at which the clutch gear supported by the gear supporting member is in mesh with the first reeling-side gear and a non-mesh position at which the clutch gear supported by the gear supporting member is not in mesh with the first reeling-side gear; a clutch impeding spring that causes a clutch impeding force of impeding movement from the mesh position to the non-mesh position to act on the gear supporting member when the feed motor starts rotating in the second rotation direction; a drive member engaged with the gear supporting member; and a clutch drive mechanism that causes the gear supporting member to move to the non-mesh position against the clutch impeding force when the feed motor rotates in the second rotation direction.

A tape printing apparatus according to a certain aspect of the present disclosure includes: an unreeling rotor engaged with an unreeling core around which an ink ribbon is wound; a reeling rotor engaged with a reeling core onto which the ink ribbon reeled out from the unreeling core is reeled; a feed motor that is rotatable in a first rotation direction and a second rotation direction, the second rotation direction being opposite of the first rotation direction; a reeling-side gear train that includes a first reeling-side gear and a clutch gear, the clutch gear being configured to move between a position at which the clutch gear is in mesh with the first reeling-side gear and a position at which the clutch gear is not in mesh with the first reeling-side gear, the reeling-side gear train being configured to transmit rotation of the feed motor to the reeling rotor so as to reel the ink ribbon onto the reeling core by meshing engagement of the clutch gear with the first reeling-side gear when the feed motor rotates in the first rotation direction, the reeling-side gear train being configured not to transmit the rotation of the feed motor to the reeling rotor by disengagement of the clutch gear from the first reeling-side gear when the feed motor rotates in the second rotation direction; an unreeling-side gear train that does not transmit the rotation of the feed motor to the unreeling rotor when the feed motor rotates in the first rotation direction and transmits the rotation of the feed motor to the unreeling rotor so as to rewind the ink ribbon onto the unreeling core when the feed motor rotates in the second rotation direction; a gear supporting member that supports the clutch gear rotatably and is configured to move between a mesh position at which the clutch gear supported by the gear supporting member is in mesh with the first reeling-side gear and a non-mesh position at which the clutch gear supported by the gear supporting member is not in mesh with the first reeling-side gear; a clutch impeding spring that causes a clutch impeding force of impeding movement from the mesh position to the non-mesh position to act on the gear supporting member when the feed motor starts rotating in the second rotation direction; a drive member engaged with the gear supporting member; a clutch drive mechanism that causes the gear supporting member to move to the non-mesh position against the clutch impeding force when the feed motor rotates in the second rotation direction; and a thermal head that performs printing on a tape using the ink ribbon.

DESCRIPTION OF EXEMPLARY EMBODIMENTS

With reference to the accompanying drawings, a ribbon reeling mechanism and a tape printing apparatus will now be explained. A tape cartridge 201 and a ribbon cartridge 301 are explained first. Either the tape cartridge 201 or the ribbon cartridge 301, not both at the same time, is selectively attached to a tape printer 1, which is a tape printing apparatus according to an exemplary embodiment. A description will be given below using directions represented by an XYZ orthogonal coordinate system illustrated in each drawing. However, the coordinate system is shown merely for the purpose of facilitating the reader's understanding and therefore shall not be construed to limit the embodiments described below.

Tape Cartridge

Figure 1:
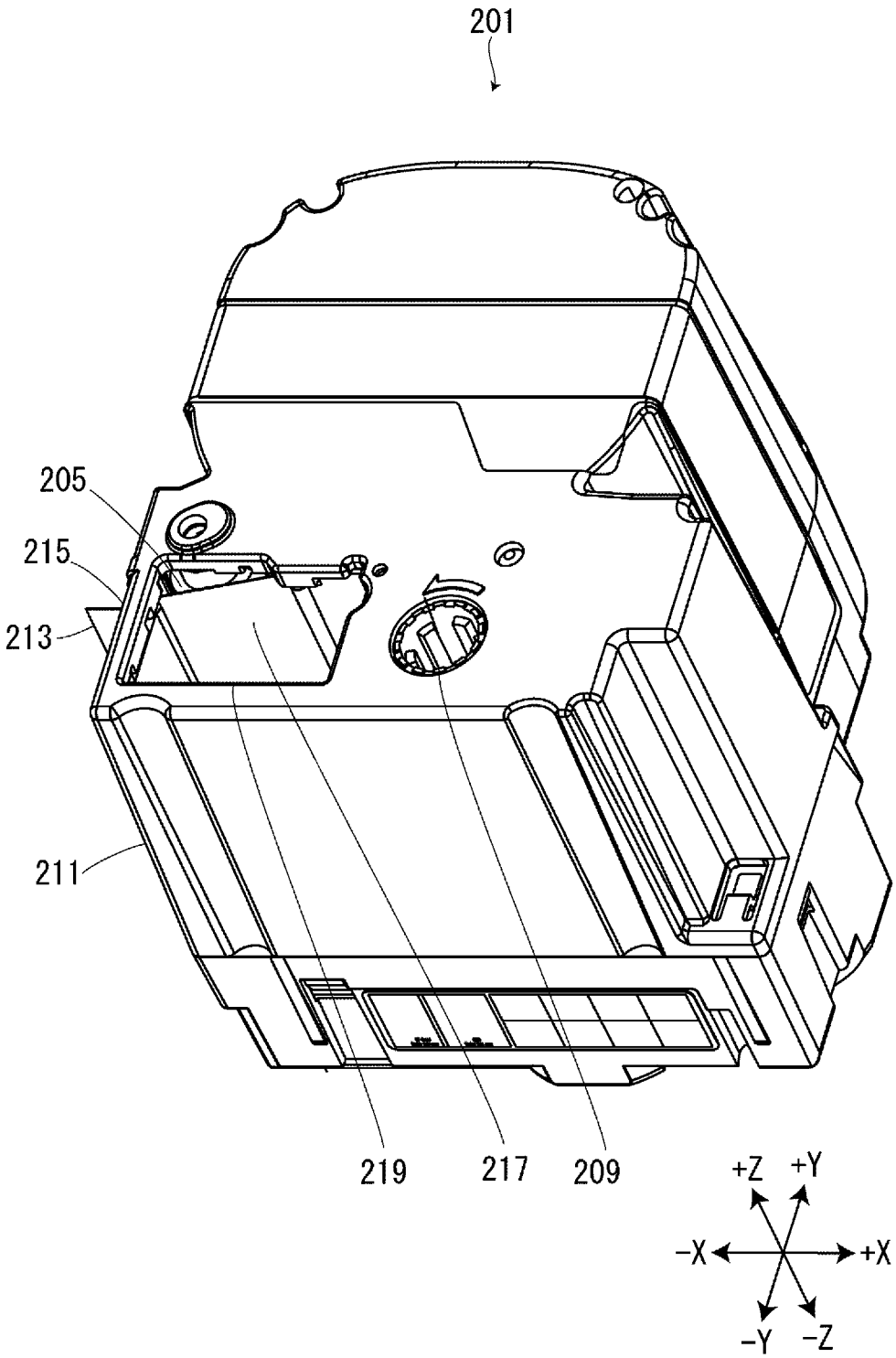
FIG. 1 is a perspective view of a tape cartridge.
Figure 4:
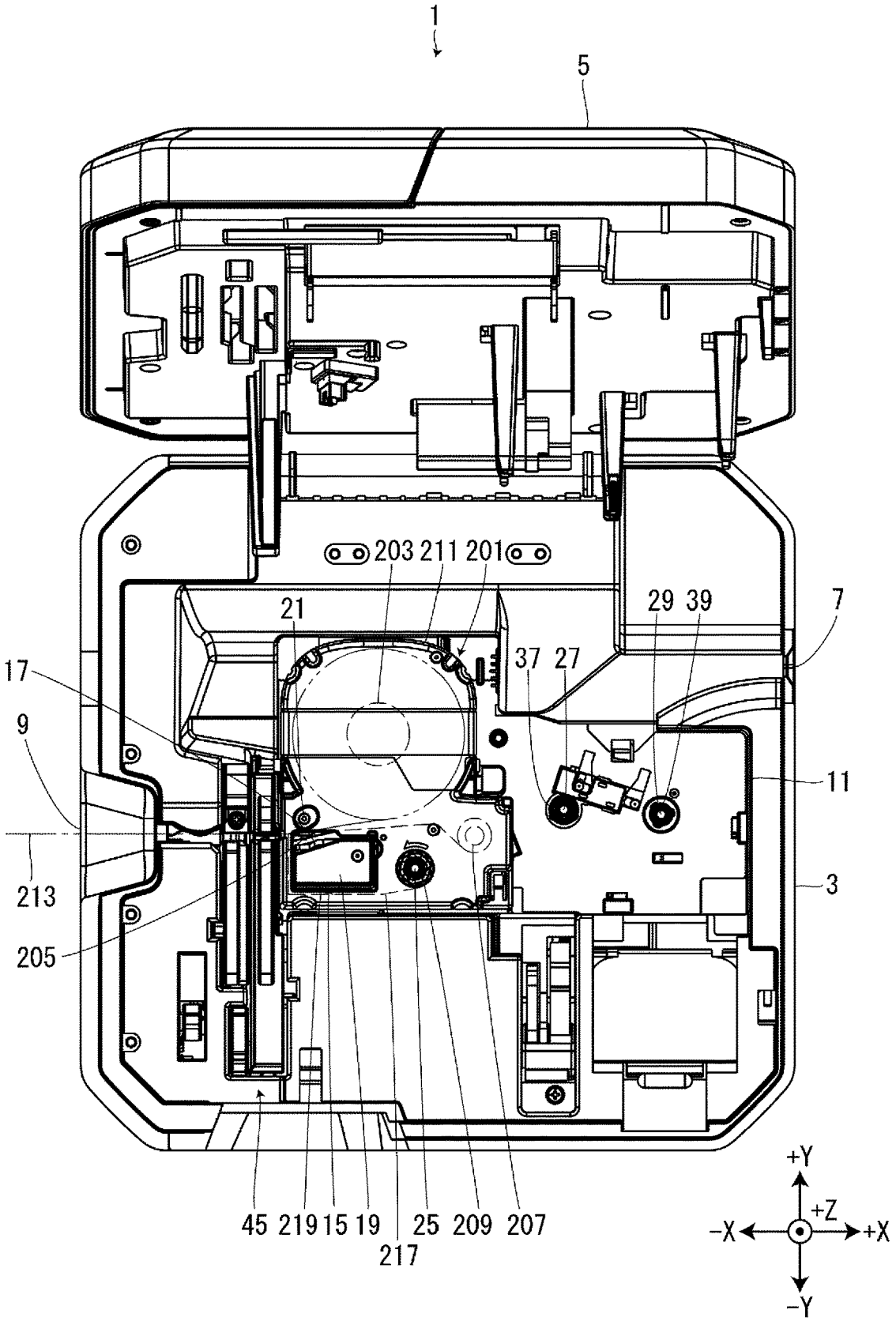
FIG. 4 is a top view, taken from the +Z-directional side, of a tape printing apparatus, with a tape cartridge attached thereto.

As illustrated in FIGS. 1 and 4, the tape cartridge 201 includes a tape core 203, a first platen roller 205, a first unreeling core 207, a first reeling core 209, and a first cartridge case 211 inside which these cores and roller are housed. A first tape 213 is wound around the tape core 203. The first tape 213 reeled out from the tape core 203 is fed to go out of the first cartridge case 211 through a tape outlet 215 provided in the −X-directional sidewall of the first cartridge case 211. A first ink ribbon 217 is wound around the first unreeling core 207. The first ink ribbon 217 reeled out from the first unreeling core 207 is reeled onto the first reeling core 209. The first cartridge case 211 serves as a housing of the tape cartridge 201. A first head insertion hole 219 is provided as an opening going through the first cartridge case 211 in the Z axis.

Ribbon Cartridge

Figure 2:
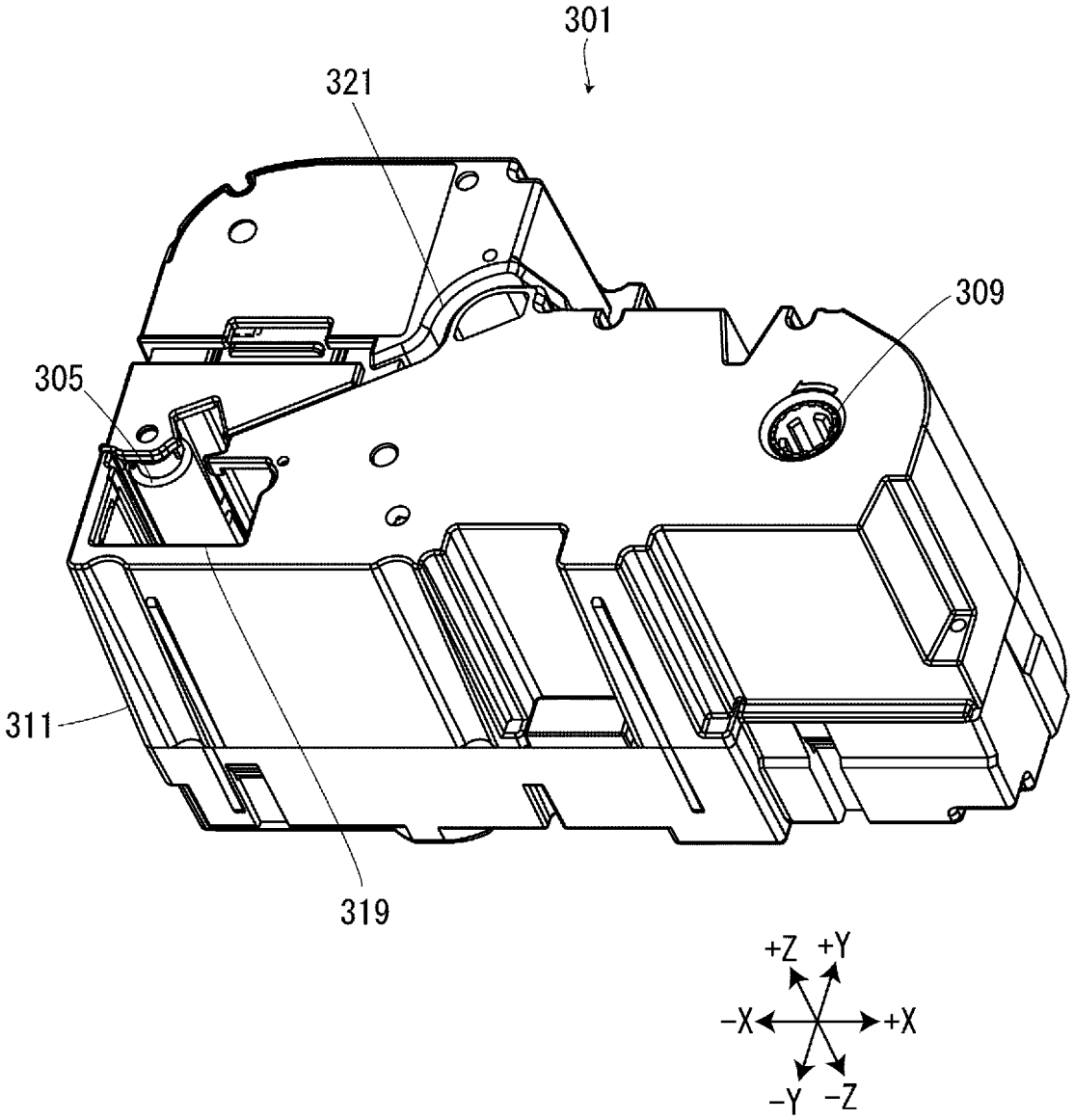
FIG. 2 is a perspective view of a ribbon cartridge.
Figure 5:
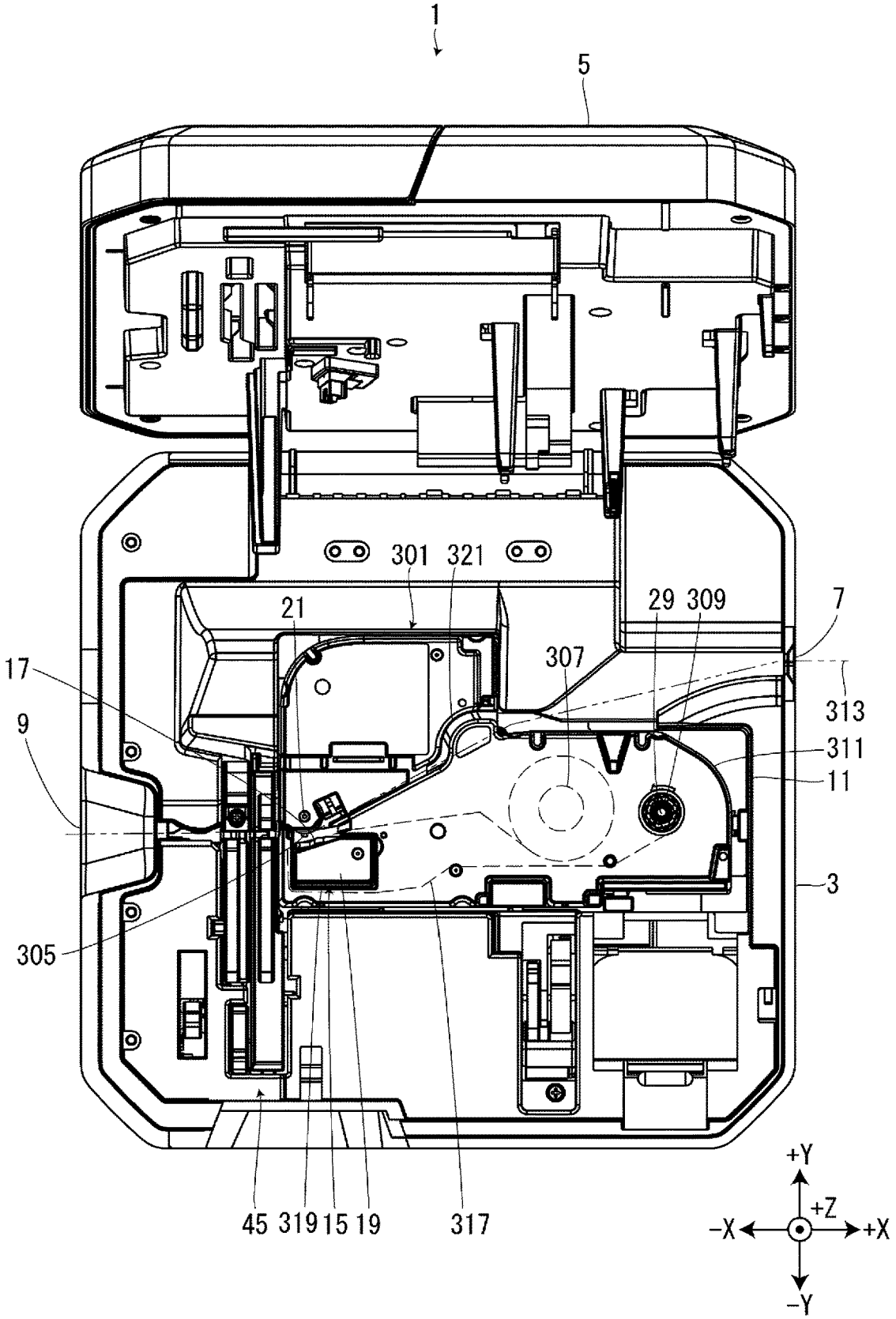
FIG. 5 is a top view, taken from the +Z-directional side, of a tape printing apparatus, with a ribbon cartridge attached thereto.

As illustrated in FIGS. 2 and 5, the ribbon cartridge 301 includes a second platen roller 305, a second unreeling core 307, a second reeling core 309, and a second cartridge case 311 inside which these cores and roller are housed. A second ink ribbon 317 is wound around the second unreeling core 307. The second ink ribbon 317 reeled out from the second unreeling core 307 is reeled onto the second reeling core 309. The second cartridge case 311 serves as a housing of the ribbon cartridge 301. A second head insertion hole 319 is provided as an opening going through the second cartridge case 311 in the Z axis. A tape path 321 is provided inside the second cartridge case 311. A second tape 313 reeled out from a non-illustrated tape roll provided outside the tape printer 1 is fed into the tape path 321. With the second tape 313 inserted in the tape path 321, the ribbon cartridge 301 is attached to a cartridge attachment portion 11 by a user.

Tape Printing Apparatus

Figure 3:
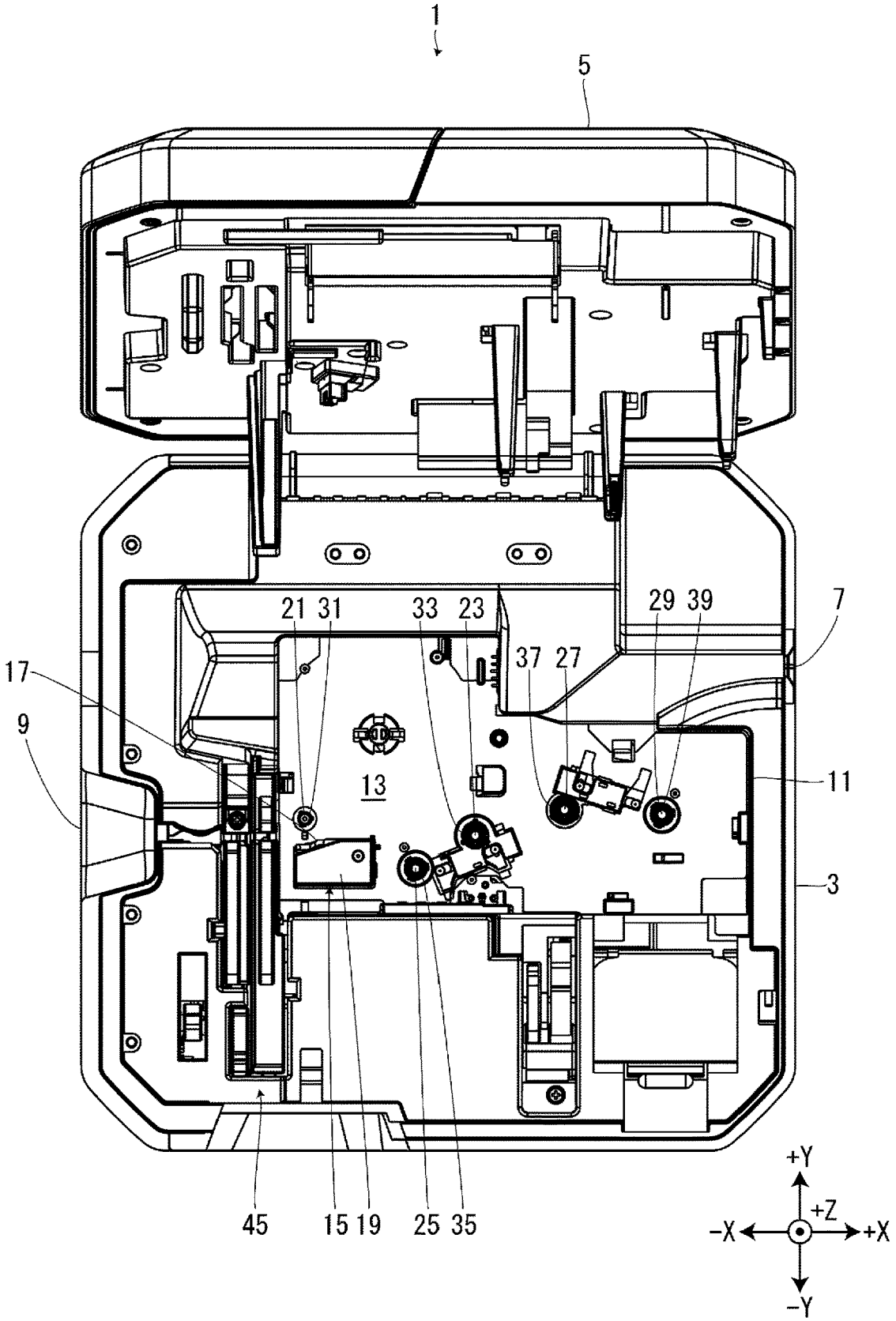
FIG. 3 is a top view, taken from the +Z-directional side, of a tape printing apparatus, with neither a tape cartridge nor a ribbon cartridge attached thereto.

As illustrated in FIGS. 3 to 5, the tape printer 1 includes an apparatus case 3 and an attachment portion cover 5. The apparatus case 3 has a shape of a substantially rectangular parallelepiped. In the +X-directional face of the apparatus case 3, an apparatus-side tape entrance 7 is provided. In the −X-directional face of the apparatus case 3, an apparatus-side tape exit 9 is provided. The second tape 313 reeled out from the tape roll goes into the apparatus case 3 through the apparatus-side tape entrance 7 and then goes out of the apparatus case 3 through the apparatus-side tape exit 9.

As illustrated in FIGS. 4 and 5, the attachment portion cover 5 is mounted on the +Y-directional end portion of the apparatus case 3 in a pivotable manner and is configured to open and close the cartridge attachment portion 11. Either the tape cartridge 201 or the ribbon cartridge 301 is selectively attached to the cartridge attachment portion 11. The cartridge attachment portion 11 has a recessed shape with an opening in the +Z direction. A head unit 15 is provided on an attachment floor 13, which is the bottom surface of the cartridge attachment portion 11. The head unit 15 includes a thermal head 17 and a head cover 19. The thermal head 17 is equipped with non-illustrated heater elements. A part of the thermal head 17 is covered by the head cover 19.

Figure 6:
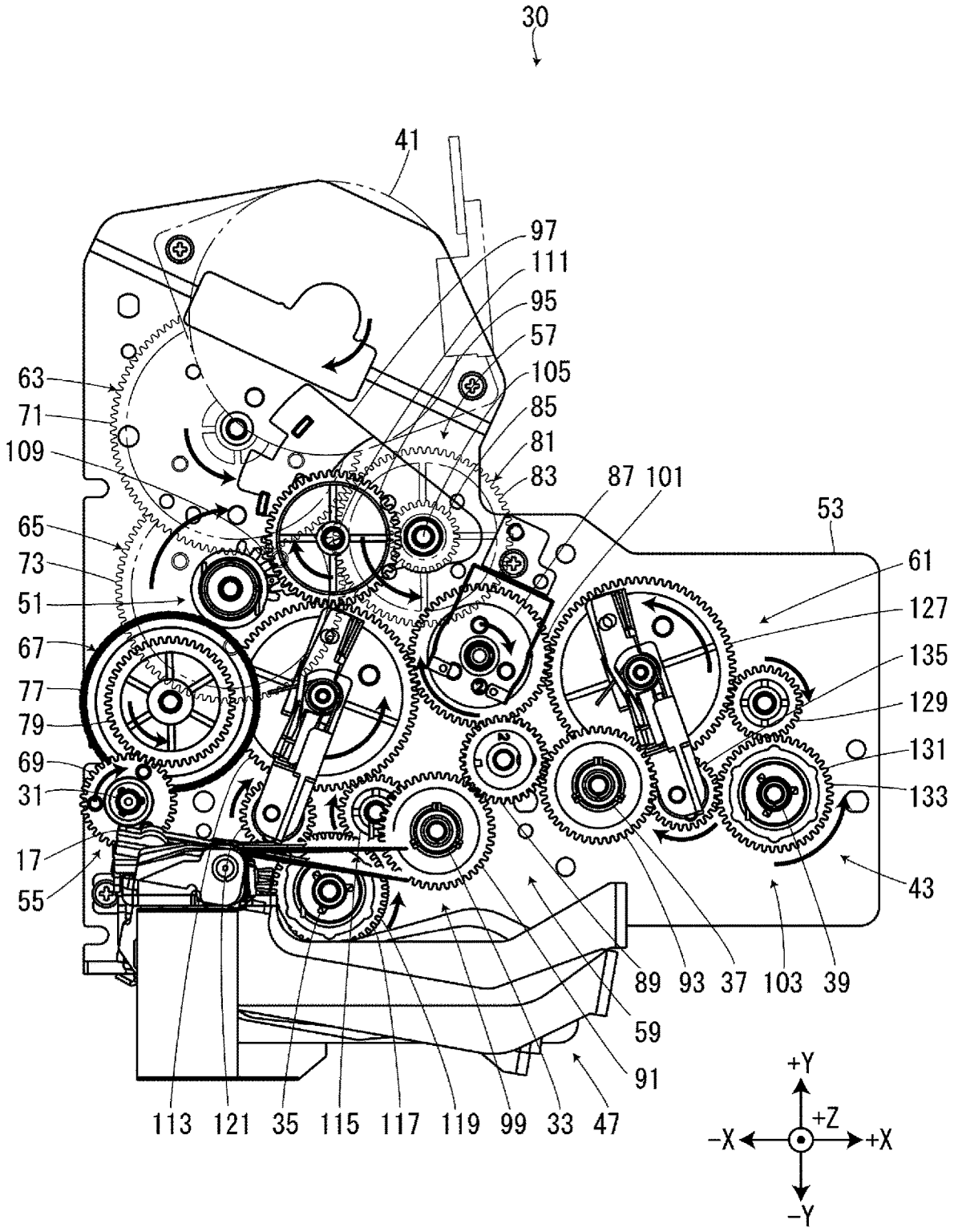
FIG. 6 is a top view, taken from the +Z-directional side, of the ribbon reeling mechanism, illustrating the direction of rotation of each component when a feed motor rotates clockwise.
Figure 7:
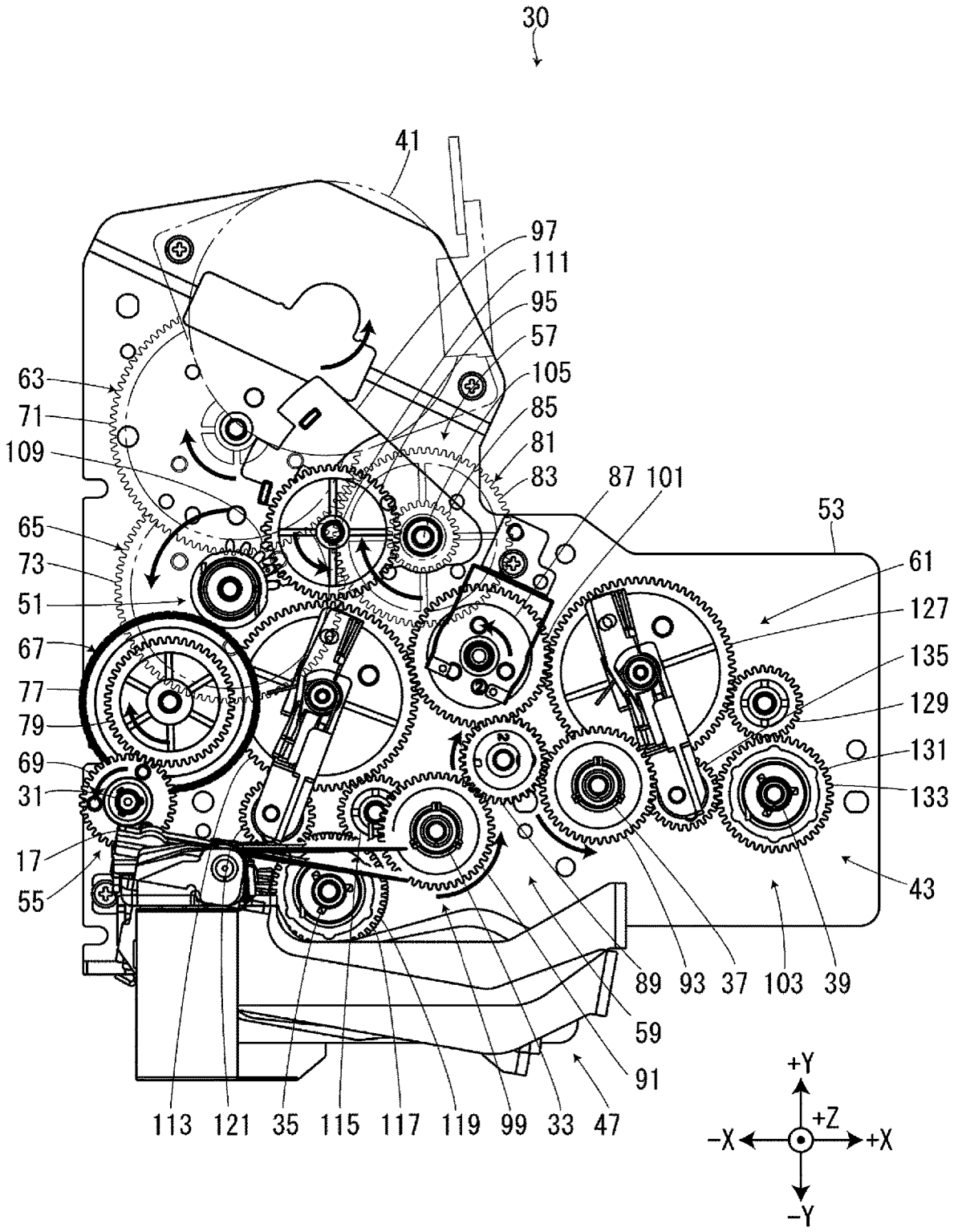
FIG. 7 is a top view, taken from the +Z-directional side, of the ribbon reeling mechanism, illustrating the direction of rotation of each component when the feed motor rotates counterclockwise.

A platen shaft 21, a first reeling shaft 25, a first unreeling shaft 23, a second unreeling shaft 27, and a second reeling shaft 29, each of which protrudes in the +Z direction, are provided on the attachment floor 13 in this order as viewed from the −X-directional side. A platen rotor 31, a first unreeling rotor 33, a first reeling rotor 35, a second unreeling rotor 37, and a second reeling rotor 39 are supported rotatably on the platen shaft 21, the first unreeling shaft 23, the first reeling shaft 25, the second unreeling shaft 27, and the second reeling shaft 29 respectively. The rotation of a feed motor 41 is transmitted to the platen rotor 31, the first unreeling rotor 33, the first reeling rotor 35, the second unreeling rotor 37, and the second reeling rotor 39 via a gear train 43, which will be described later, as illustrated in FIGS. 6 and 7.

The feed motor 41 is a driver that causes the platen rotor 31, the first unreeling rotor 33, the first reeling rotor 35, the second unreeling rotor 37, and the second reeling rotor 39 to rotate. The feed motor 41 is able to rotate clockwise and counterclockwise as illustrated in FIGS. 6 and 7. The clockwise rotation of the feed motor 41 means that the output shaft of the feed motor 41 rotates clockwise. Similarly, the counterclockwise rotation of the feed motor 41 means that the output shaft of the feed motor 41 rotates counterclockwise. The term "clockwise" means a clockwise direction as viewed from the +Z-directional side. Similarly, the term "counterclockwise" means a counterclockwise direction as viewed from the +Z-directional side.

A cutter 45 is provided between the cartridge attachment portion 11 and the apparatus-side tape exit 9. The cutter 45 cuts the first tape 213 or the second tape 313. Driven by a non-illustrated cutter motor, the cutter 45 performs cutting operation.

As illustrated in FIG. 4, when the user attaches the tape cartridge 201 to the cartridge attachment portion 11, the head unit 15 is inserted into the first head insertion hole 219. In addition, the platen shaft 21, the first unreeling shaft 23, and the first reeling shaft 25 are inserted into the first platen roller 205, the first unreeling core 207, and the first reeling core 209 respectively. The insertion brings the platen rotor 31, the first unreeling rotor 33, and the first reeling rotor 35 into engagement with the first platen roller 205, the first unreeling core 207, and the first reeling core 209 respectively.

When the user closes the attachment portion cover 5 after attaching the tape cartridge 201 to the cartridge attachment portion 11, the thermal head 17 is driven by a head movement mechanism 47 illustrated in FIGS. 6 and 7 to move toward the platen shaft 21. Due to this head movement, the first tape 213 and the first ink ribbon 217 are nipped between the thermal head 17 and the first platen roller 205.

In this state, when the feed motor 41 rotates clockwise, as illustrated in FIG. 6, the rotation of the feed motor 41 is transmitted via the gear train 43 to the platen rotor 31 and the first reeling rotor 35. Due to the motor power, the first platen roller 205 rotates clockwise, and the first reeling core 209 rotates counterclockwise. As a result, the first tape 213 is fed forward, that is, fed toward the apparatus-side tape exit 9, and, in addition, the first ink ribbon 217 is fed from the first unreeling core 207 toward the first reeling core 209 and is then reeled onto the first reeling core 209.

When the feed motor 41 rotates counterclockwise, as illustrated in FIG. 7, the rotation of the feed motor 41 is transmitted via the gear train 43 to the platen rotor 31 and the first unreeling rotor 33. Due to the motor power, the first platen roller 205 rotates counterclockwise, and the first unreeling core 207 rotates counterclockwise. As a result, the first tape 213 is fed backward, that is, fed in the reverse direction, which is the opposite of the forward direction going toward the apparatus-side tape exit 9, and, in addition, the first ink ribbon 217 is fed from the first reeling core 209 toward the first unreeling core 207 and is then rewound onto the first unreeling core 207.

The tape printer 1 receives instructions to perform printing from the user. When instructed, the tape printer 1 causes the thermal head 17 to generate heat while feeding the first tape 213 and the first ink ribbon 217 forward by rotating the feed motor 41 clockwise to rotate the first platen roller 205, thereby printing, on the first tape 213, a print image based on print data. The print data may be generated based on, for example, an input operation of typing characters, etc. into the tape printer 1. Alternatively, the tape printer 1 may receive the print data from an external apparatus such as a personal computer. After completion of the printing, the tape printer 1 cuts the printed part of the first tape 213 off by means of the cutter 45. After the cutting, the tape printer 1 pulls the first tape 213 back by rotating the feed motor 41 counterclockwise until the leading end of the first tape 213 comes near the nip position between the thermal head 17 and the first platen roller 205. This operation makes it possible to reduce the length of a blank space that will be formed at the leading-end portion of the first tape 213 in the length direction when the next printing is performed on the first tape 213.

As illustrated in FIG. 5, when the user attaches the ribbon cartridge 301 to the cartridge attachment portion 11, the head unit 15 is inserted into the second head insertion hole 319. In addition, the platen shaft 21, the second unreeling shaft 27, and the second reeling shaft 29 are inserted into the second platen roller 305, the second unreeling core 307, and the second reeling core 309 respectively. The insertion brings the platen rotor 31, the second unreeling rotor 37, and the second reeling rotor 39 into engagement with the second platen roller 305, the second unreeling core 307, and the second reeling core 309 respectively.

When the user closes the attachment portion cover 5 after attaching the ribbon cartridge 301 to the cartridge attachment portion 11, the thermal head 17 is driven by the head movement mechanism 47 to move toward the platen shaft 21. Due to this head movement, the second tape 313 and the second ink ribbon 317 are nipped between the thermal head 17 and the second platen roller 305.

In this state, when the feed motor 41 rotates clockwise, as illustrated in FIG. 6, the rotation of the feed motor 41 is transmitted via the gear train 43 to the platen rotor 31 and the second reeling rotor 39. Due to the motor power, the second platen roller 305 rotates clockwise, and the second reeling core 309 rotates counterclockwise. As a result, the second tape 313 is fed forward, that is, fed toward the apparatus-side tape exit 9, and, in addition, the second ink ribbon 317 is fed from the second unreeling core 307 toward the second reeling core 309 and is then reeled onto the second reeling core 309.

When the feed motor 41 rotates counterclockwise, as illustrated in FIG. 7, the rotation of the feed motor 41 is transmitted via the gear train 43 to the platen rotor 31 and the second unreeling rotor 37. Due to the motor power, the second platen roller 305 rotates counterclockwise, and the second unreeling core 307 rotates counterclockwise. As a result, the second tape 313 is fed backward, that is, fed in the reverse direction, which is the opposite of the forward direction going toward the apparatus-side tape exit 9, and, in addition, the second ink ribbon 317 is fed from the second reeling core 309 toward the second unreeling core 307 and is then rewound onto the second unreeling core 307.

The tape printer 1 receives instructions to perform printing from the user. When instructed, the tape printer 1 causes the thermal head 17 to generate heat while feeding the second tape 313 and the second ink ribbon 317 forward by rotating the feed motor 41 clockwise to rotate the second platen roller 305, thereby printing, on the second tape 313, a print image based on print data. After completion of the printing, the tape printer 1 cuts the printed part of the second tape 313 off by means of the cutter 45. After the cutting, the tape printer 1 pulls the second tape 313 back by rotating the feed motor 41 counterclockwise until the leading end of the second tape 313 comes near the nip position between the thermal head 17 and the second platen roller 305. This operation makes it possible to reduce the length of a blank space that will be formed at the leading-end portion of the second tape 313 in the length direction when the next printing is performed on the second tape 313.

Ribbon Reeling Mechanism

With reference to FIGS. 6 and 7, a ribbon reeling mechanism 30 included in the tape printer 1 will now be explained. In FIG. 6, the arrows indicate the directions in which the feed motor 41, the platen rotor 31, the first reeling rotor 35, the second reeling rotor 39, and each of gears that make up the gear train 43 rotate respectively when the feed motor 41 rotates clockwise. In FIG. 7, the arrows indicate the directions in which the feed motor 41, the platen rotor 31, the first unreeling rotor 33, the second unreeling rotor 37, and each of gears that make up the gear train 43 rotate respectively when the feed motor 41 rotates counterclockwise. In FIGS. 6 and 7, the feed motor 41, a first feed gear 63, a second feed gear 65, and a first relay gear 81 are virtually shown by two-dot chain illustration in order to depict a structure disposed on the −Z-directional side in relation to these rotors and gears.

The ribbon reeling mechanism 30 includes the platen rotor 31, the first unreeling rotor 33, the first reeling rotor 35, the second unreeling rotor 37, and the second reeling rotor 39, and the feed motor 41 described above. The ribbon reeling mechanism 30 further includes the gear train 43, a clutch drive mechanism 51, and a frame 53 supporting these components.

The gear train 43 transmits the rotation of the feed motor 41 to the platen rotor 31, the first unreeling rotor 33, the first reeling rotor 35, the second unreeling rotor 37, and the second reeling rotor 39. The gear train 43 includes a feed gear train 55, a relay gear train 57, an unreeling-side gear train 59, and a reeling-side gear train 61.

The feed gear train 55 transmits the rotation of the feed motor 41 to the platen rotor 31 and the relay gear train 57. The feed gear train 55 includes the first feed gear 63, the second feed gear 65, a third feed gear 67, and a fourth feed gear 69.

The first feed gear 63 is a two-tiered gear. The first feed gear 63 includes a first feed larger-diameter portion 71 and a non-illustrated first feed smaller-diameter portion. The first feed larger-diameter portion 71 is in mesh with a non-illustrated output gear provided on the output shaft of the feed motor 41. The first feed smaller-diameter portion, the diameter of which is smaller than that of the first feed larger-diameter portion 71, is formed integrally with the first feed larger-diameter portion 71 on the −Z-directional face of the first feed larger-diameter portion 71.

The second feed gear 65 is a two-tiered gear. The second feed gear 65 includes a second feed larger-diameter portion 73 and a second feed smaller-diameter portion 75 illustrated in FIG. 12. The second feed larger-diameter portion 73 is in mesh with the first feed smaller-diameter portion. The second feed smaller-diameter portion 75, the diameter of which is smaller than that of the second feed larger-diameter portion 73, is formed integrally with the second feed larger-diameter portion 73 on the −Z-directional face of the second feed larger-diameter portion 73. More specifically, the second feed smaller-diameter portion 75 has a teethed cylindrical shape and protrudes from the −Z-directional face of the second feed larger-diameter portion 73.

The third feed gear 67 is a two-tiered gear. The third feed gear 67 includes a third feed larger-diameter portion 77 and a third feed smaller-diameter portion 79. The third feed larger-diameter portion 77 is in mesh with the second feed smaller-diameter portion 75. The third feed smaller-diameter portion 79, the diameter of which is smaller than that of the third feed larger-diameter portion 77, is formed integrally with the third feed larger-diameter portion 77 on the +Z-directional face of the third feed larger-diameter portion 77.

The fourth feed gear 69 is in mesh with the third feed smaller-diameter portion 79. The fourth feed gear 69, together with the platen rotor 31, is provided rotatably on the platen shaft 21. The rotation of the fourth feed gear 69 causes the platen rotor 31 to rotate in the same direction as that of the fourth feed gear 69.

The relay gear train 57 transmits the rotation of the feed motor 41, which is inputted via the feed gear train 55, to the unreeling-side gear train 59 and the reeling-side gear train 61. The relay gear train 57 includes the first relay gear 81 and a non-illustrated second relay gear.

The first relay gear 81 is a three-tiered gear. The first relay gear 81 includes a first relay larger-diameter portion 83, a first relay medium-diameter portion 85, and a non-illustrated first relay smaller-diameter portion. The first relay larger-diameter portion 83 is in mesh with the second feed larger-diameter portion 73. The first relay medium-diameter portion 85, the diameter of which is smaller than that of the first relay larger-diameter portion 83, is formed integrally with the first relay larger-diameter portion 83 on the +Z-directional face of the first relay larger-diameter portion 83. The first relay smaller-diameter portion, the diameter of which is smaller than that of the first relay medium-diameter portion 85, is formed integrally with the first relay larger-diameter portion 83 on the −Z-directional face of the first relay larger-diameter portion 83. The second relay gear is provided coaxially with a one-way clutch 87 described below. The second relay gear is in mesh with the first relay medium-diameter portion 85.

As illustrated in FIG. 6, the unreeling-side gear train 59 does not transmit the rotation of the feed motor 41, which is inputted via the relay gear train 57, to the first unreeling rotor 33 and the second unreeling rotor 37 when the feed motor 41 rotates clockwise. As illustrated in FIG. 7, the unreeling-side gear train 59 transmits the rotation of the feed motor 41, which is inputted via the relay gear train 57, to the first unreeling rotor 33 and the second unreeling rotor 37 when the feed motor 41 rotates counterclockwise.

The unreeling-side gear train 59 includes the one-way clutch 87, a first unreeling-side gear 89, a second unreeling-side gear 91, and a third unreeling-side gear 93. The one-way clutch 87 is provided coaxially with the second relay gear. The one-way clutch 87 does not transmit the rotation of the feed motor 41, which is inputted via the relay gear train 57, to the first unreeling-side gear 89 when the feed motor 41 rotates clockwise. The one-way clutch 87 transmits the rotation of the feed motor 41, which is inputted via the relay gear train 57, to the first unreeling-side gear 89 when the feed motor 41 rotates counterclockwise.

The rotation of the feed motor 41 is transmitted to the first unreeling-side gear 89 via the one-way clutch 87. The second unreeling-side gear 91 is in mesh with the first unreeling-side gear 89. The second unreeling-side gear 91, together with the first unreeling rotor 33, is provided rotatably on the first unreeling shaft 23. The rotation of the second unreeling-side gear 91 causes the first unreeling rotor 33 to rotate in the same direction as the second unreeling-side gear 91. The third unreeling-side gear 93 is in mesh with the first unreeling-side gear 89 and is provided rotatably on the second unreeling shaft 27, together with the second unreeling rotor 37. The rotation of the third unreeling-side gear 93 causes the second unreeling rotor 37 to rotate in the same direction as the third unreeling-side gear 93.

As illustrated in FIG. 6, the reeling-side gear train 61 transmits the rotation of the feed motor 41, which is inputted via the relay gear train 57, to the first reeling rotor 35 and the second reeling rotor 39 when the feed motor 41 rotates clockwise. As illustrated in FIG. 7, the reeling-side gear train 61 does not transmit the rotation of the feed motor 41, which is inputted via the relay gear train 57, to the first reeling rotor 35 and the second reeling rotor 39 when the feed motor 41 rotates counterclockwise.

The reeling-side gear train 61 includes a clutch gear 95, a gear supporting member 97, a first reeling-side gear train 99, an intermediate gear 101, and a second reeling-side gear train 103.

The clutch gear 95 is supported rotatably by the gear supporting member 97 and is in mesh with the first relay smaller-diameter portion. The clutch gear 95 is able to move between a position illustrated in FIG. 6, at which the clutch gear 95 is in mesh with a first reeling-side gear 113 of the first reeling-side gear train 99, and a position illustrated in FIG. 7, at which the clutch gear 95 is not in mesh with the first reeling-side gear 113.

The gear supporting member 97 is provided in such a way as to be able to rotate around a rotation shaft 105 protruding from the frame 53 in the +Z direction. The first relay gear 81 described above is also provided rotatably on the rotation shaft 105. The gear supporting member 97 is able to turn between a mesh position at which the clutch gear 95 supported by the gear supporting member 97 is in mesh with the first reeling-side gear 113 as illustrated in FIG. 6 and a non-mesh position at which the clutch gear 95 supported by the gear supporting member 97 is not in mesh with the first reeling-side gear 113 as illustrated in FIG. 7.

Driven by the clutch drive mechanism 51 described later, the gear supporting member 97 turns counterclockwise toward the mesh position when the feed motor 41 rotates clockwise as illustrated in FIG. 6. As a result of this turn, the clutch gear 95 comes into mesh with the first reeling-side gear 113. Therefore, the rotation of the feed motor 41 is transmitted to the first reeling rotor 35 and the second reeling rotor 39, and the first reeling rotor 35 and the second reeling rotor 39 rotate. When the feed motor 41 rotates counterclockwise, as illustrated in FIG. 7, the gear supporting member 97 is driven by the clutch drive mechanism 51 to turn clockwise toward the non-mesh position. As a result of this turn, the clutch gear 95 becomes disengaged from the first reeling-side gear 113. Therefore, the rotation of the feed motor 41 is not transmitted to the first reeling rotor 35 and the second reeling rotor 39, and the first reeling rotor 35 and the second reeling rotor 39 do not rotate.

Figure 13:
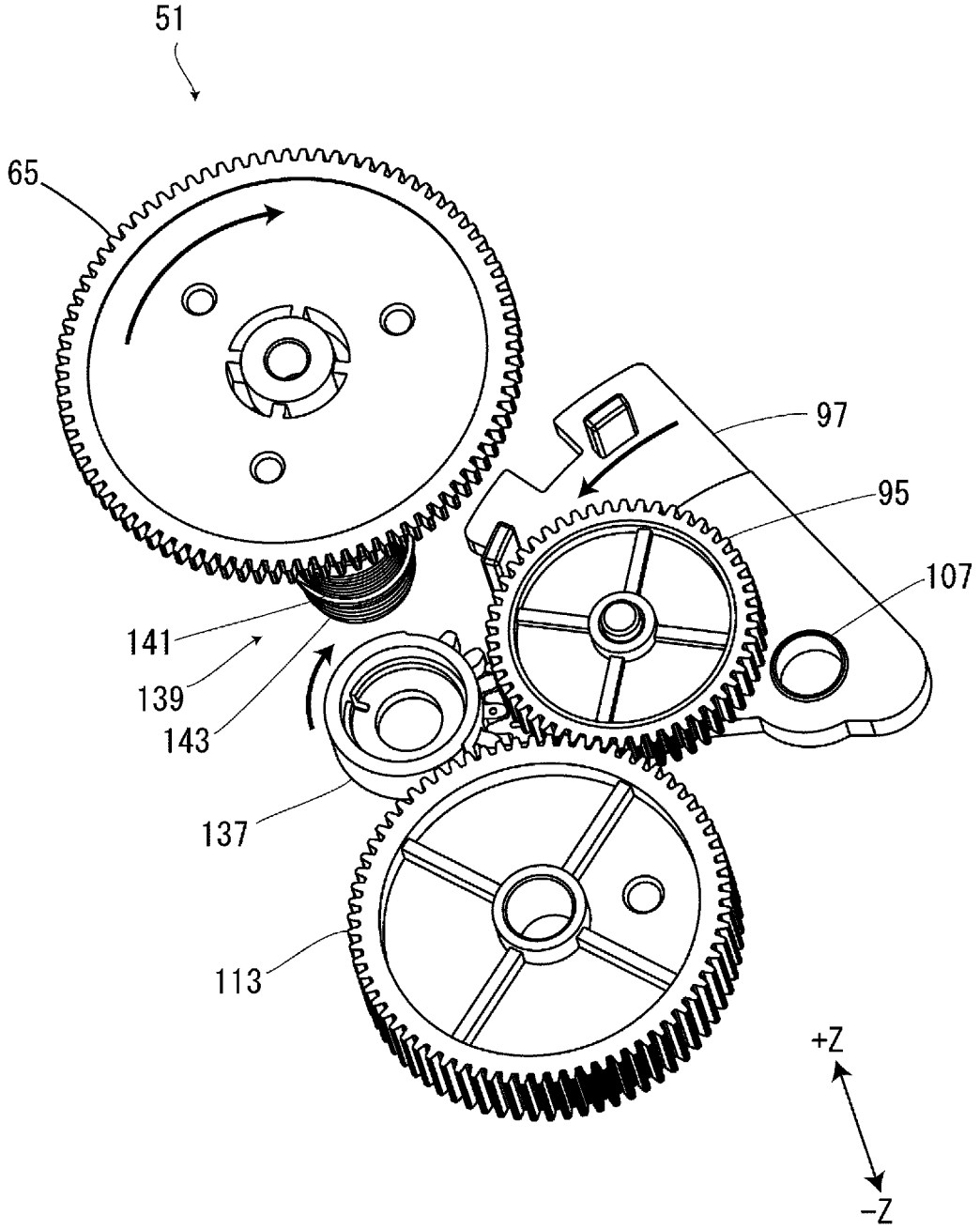
FIG. 13 is a diagram that illustrates the motion of each component of the clutch drive mechanism when the feed motor rotates clockwise.

The gear supporting member 97 is a plate-type member that has a shape like a fan. A shaft insertion hole 107 illustrated in FIG. 13 is provided at the +X-side end portion of the gear supporting member 97. The rotation shaft 105 is inserted through the shaft insertion hole 107. A support-side teeth portion 109 is provided on the −X-side end portion of the gear supporting member 97. The support-side teeth portion 109 is in mesh with a drive-side teeth portion 151 of a drive member 137 described later. A gear supporting shaft 111 is provided between the shaft insertion hole 107 and the support-side teeth portion 109. The gear supporting shaft 111 supports the clutch gear 95 rotatably. A non-illustrated position-restricting concave portion is provided in the −Z-directional face of the gear supporting member 97. The position-restricting concave portion is in engagement with a non-illustrated position-restricting convex portion protruding from the frame 53 in the +Z direction. After the gear supporting member 97 starts to turn clockwise from the mesh position, the inner surface of the position-restricting concave portion collides with the position-restricting convex portion, thereby restricting the position of the gear supporting member 97 at the non-mesh position.

The first reeling-side gear train 99 transmits the rotation of the feed motor 41, which is inputted via the clutch gear 95, to the first reeling rotor 35. The first reeling-side gear train 99 includes the first reeling-side gear 113, a second reeling-side gear 115, a third reeling-side gear 117, a fourth reeling-side gear 119, and a first movable gear 121. The first reeling-side gear 113 is configured to be able to mesh with the clutch gear 95. The second reeling-side gear 115 is in mesh with the first reeling-side gear 113. The third reeling-side gear 117 and the fourth reeling-side gear 119 are provided rotatably on the first reeling shaft 25, together with the first reeling rotor 35. The third reeling-side gear 117 is in mesh with the second reeling-side gear 115. The fourth reeling-side gear 119 is provided between the third reeling-side gear 117 and the first reeling rotor 35.

Figure 8:
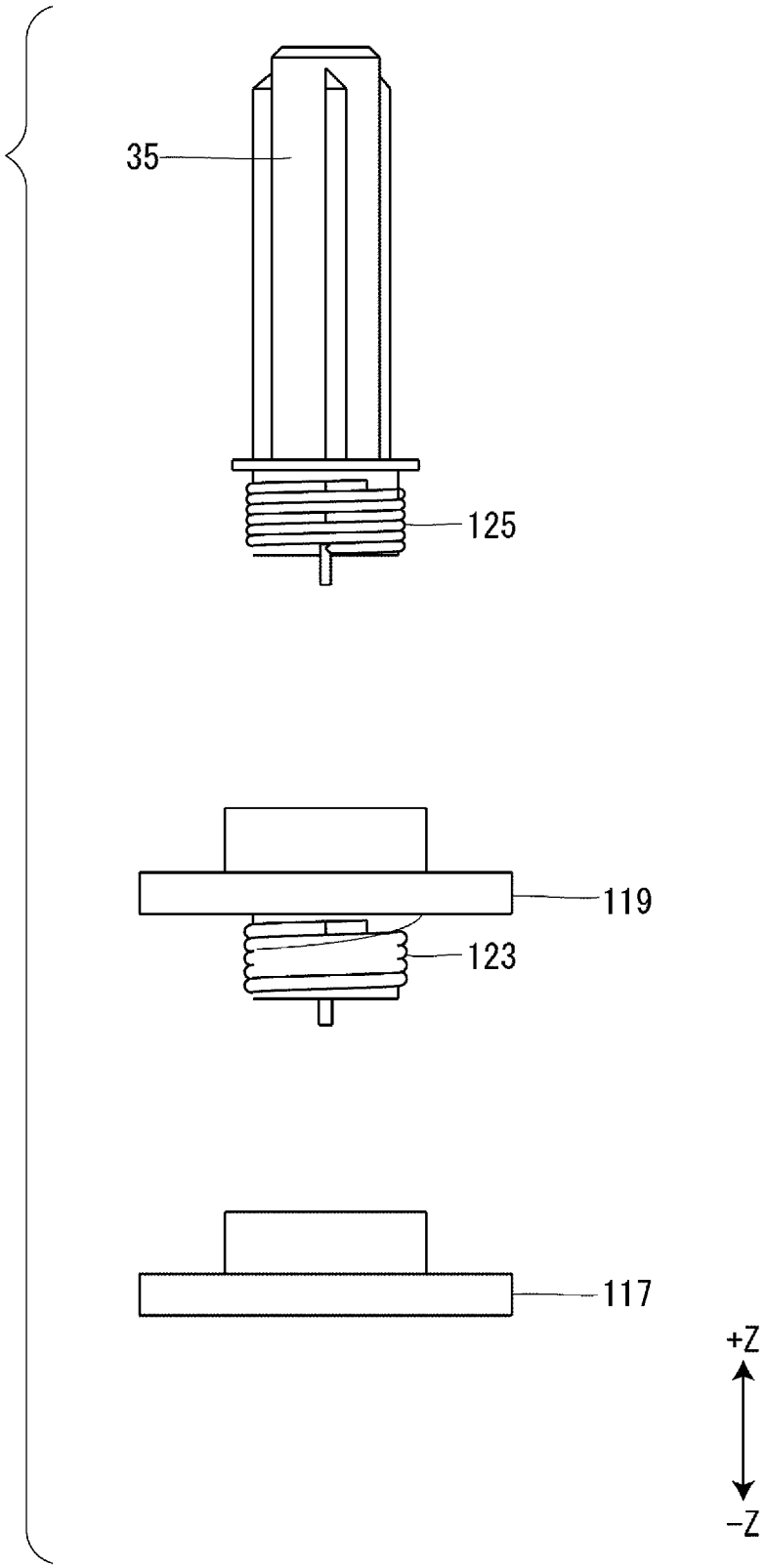
FIG. 8 is a diagram that illustrates peripheral components around a first reeling rotor.

As illustrated in FIG. 8, the third reeling-side gear 117 and the fourth reeling-side gear 119 are coupled to each other via a first reeling slip spring 123. The first reeling slip spring 123 is a torsion coil spring. When the third reeling-side gear 117 rotates counterclockwise, the first reeling slip spring 123 deforms elastically in such a way as to slip with respect to the fourth reeling-side gear 119, thereby limiting a torque transmitted from the third reeling-side gear 117 to the fourth reeling-side gear 119. The fourth reeling-side gear 119 and the first reeling rotor 35 are coupled to each other via a second reeling slip spring 125. The second reeling slip spring 125 is a torsion coil spring. When the fourth reeling-side gear 119 rotates counterclockwise, the second reeling slip spring 125 deforms elastically in such a way as to slip with respect to the first reeling rotor 35, thereby limiting a torque transmitted from the fourth reeling-side gear 119 to the first reeling rotor 35. The torque transmitted by the second reeling slip spring 125 is larger than the torque transmitted by the first reeling slip spring 123.

Driven by a non-illustrated first reeling torque switching mechanism, the first movable gear 121 is able to move between a position where it meshes with the fourth reeling-side gear 119 and a position where it does not mesh with the fourth reeling-side gear 119. When a tape cartridge 201 containing a wide first ink ribbon 217 is attached to the cartridge attachment portion 11, the first movable gear 121 driven by the first reeling torque switching mechanism moves to the position where it meshes with the fourth reeling-side gear 119. As a result, the torque transmitted to the first reeling rotor 35 increases. When a tape cartridge 201 containing a narrow first ink ribbon 217 is attached to the cartridge attachment portion 11, the first movable gear 121 driven by the first reeling torque switching mechanism moves to the position where it does not mesh with the fourth reeling-side gear 119. As a result, the torque transmitted to the first reeling rotor 35 decreases. As explained above, in a case where a tape cartridge 201 containing a wide first ink ribbon 217 is attached to the cartridge attachment portion 11, as compared with a case where a tape cartridge 201 containing a narrow first ink ribbon 217 is attached to the cartridge attachment portion 11, it is possible to make the torque for reeling the first ink ribbon 217 larger. Therefore, it is possible to reel the wide first ink ribbon 217 properly.

The intermediate gear 101 is provided between the first reeling-side gear 113 of the first reeling-side gear train 99 and a fifth reeling-side gear 127 of the second reeling-side gear train 103. The intermediate gear 101 is provided coaxially with the second relay gear and the one-way clutch 101.

The second reeling-side gear train 103 transmits the rotation of the feed motor 41, which is inputted via the intermediate gear 101, to the second reeling rotor 39. The second reeling-side gear train 103 has the same configuration as that of the first reeling-side gear train 99. Namely, the second reeling-side gear train 103 includes the fifth reeling-side gear 127, a sixth reeling-side gear 129, a seventh reeling-side gear 131, an eighth reeling-side gear 133, and a second movable gear 135. The fifth reeling-side gear 127 is in mesh with the intermediate gear 101. The sixth reeling-side gear 129 is in mesh with the fifth reeling-side gear 127. The seventh reeling-side gear 131 and the eighth reeling-side gear 133 are provided rotatably on the second reeling shaft 29, together with the second reeling rotor 39. The seventh reeling-side gear 131 is in mesh with the sixth reeling-side gear 129. The eighth reeling-side gear 133 is provided between the seventh reeling-side gear 131 and the second reeling rotor 39.

The seventh reeling-side gear 131 and the eighth reeling-side gear 133 are coupled to each other via a third reeling slip spring, though not illustrated. The third reeling slip spring is a torsion coil spring. When the seventh reeling-side gear 131 rotates counterclockwise, the third reeling slip spring deforms elastically in such a way as to slip with respect to the eighth reeling-side gear 133, thereby limiting a torque transmitted from the seventh reeling-side gear 131 to the eighth reeling-side gear 133. The eighth reeling-side gear 133 and the second reeling rotor 39 are coupled to each other via a fourth reeling slip spring. The fourth reeling slip spring is a torsion coil spring. When the fourth reeling-side gear 119 rotates counterclockwise, the fourth reeling slip spring deforms elastically in such a way as to slip with respect to the second reeling rotor 39, thereby limiting a torque transmitted from the eighth reeling-side gear 133 to the second reeling rotor 39. The torque transmitted by the fourth reeling slip spring is larger than the torque transmitted by the third reeling slip spring.

Driven by a non-illustrated second reeling torque switching mechanism, the second movable gear 135 is able to move between a position where it meshes with the eighth reeling-side gear 133 and a position where it does not mesh with the eighth reeling-side gear 133. When a ribbon cartridge 301 containing a wide second ink ribbon 317 is attached to the cartridge attachment portion 11, the second movable gear 135 driven by the second reeling torque switching mechanism moves to the position where it meshes with the eighth reeling-side gear 133. As a result, the torque transmitted to the second reeling rotor 39 increases. When a ribbon cartridge 301 containing a narrow second ink ribbon 317 is attached to the cartridge attachment portion 11, the second movable gear 135 driven by the second reeling torque switching mechanism moves to the position where it does not mesh with the eighth reeling-side gear 133. As a result, the torque transmitted to the second reeling rotor 39 decreases. As explained above, in a case where a ribbon cartridge 301 containing a wide second ink ribbon 317 is attached to the cartridge attachment portion 11, as compared with a case where a ribbon cartridge 301 containing a narrow second ink ribbon 317 is attached to the cartridge attachment portion 11, it is possible to make the torque for reeling the second ink ribbon 317 larger. Therefore, it is possible to reel the wide second ink ribbon 317 properly.

In the ribbon reeling mechanism 30 having the above configuration, as illustrated in FIG. 6, when the feed motor 41 rotates clockwise, the rotation of the feed motor 41 is transmitted via the gear train 43 to the platen rotor 31, the first reeling rotor 35, and the second reeling rotor 39, but is not transmitted to the first unreeling rotor 33 and the second unreeling rotor 37. As a result, the platen rotor 31, the first reeling rotor 35, and the second reeling rotor 39 rotate, but the first unreeling rotor 33 and the second unreeling rotor 37 do not rotate. On the other hand, as illustrated in FIG. 7, when the feed motor 41 rotates counterclockwise, the rotation of the feed motor 41 is transmitted via the gear train 43 to the platen rotor 31, the first unreeling rotor 33, and the second unreeling rotor 37, but is not transmitted to the first reeling rotor 35 and the second reeling rotor 39. As a result, the platen rotor 31, the first unreeling rotor 33, and the second unreeling rotor 37 rotate, but the first reeling rotor 35 and the second reeling rotor 39 do not rotate.

To give an example, the operation of each component of the reeling-side gear train 61 in a case where a tape cartridge 201 containing a wide first ink ribbon 217 is attached to the cartridge attachment portion 11 will now be explained.

Figure 9:
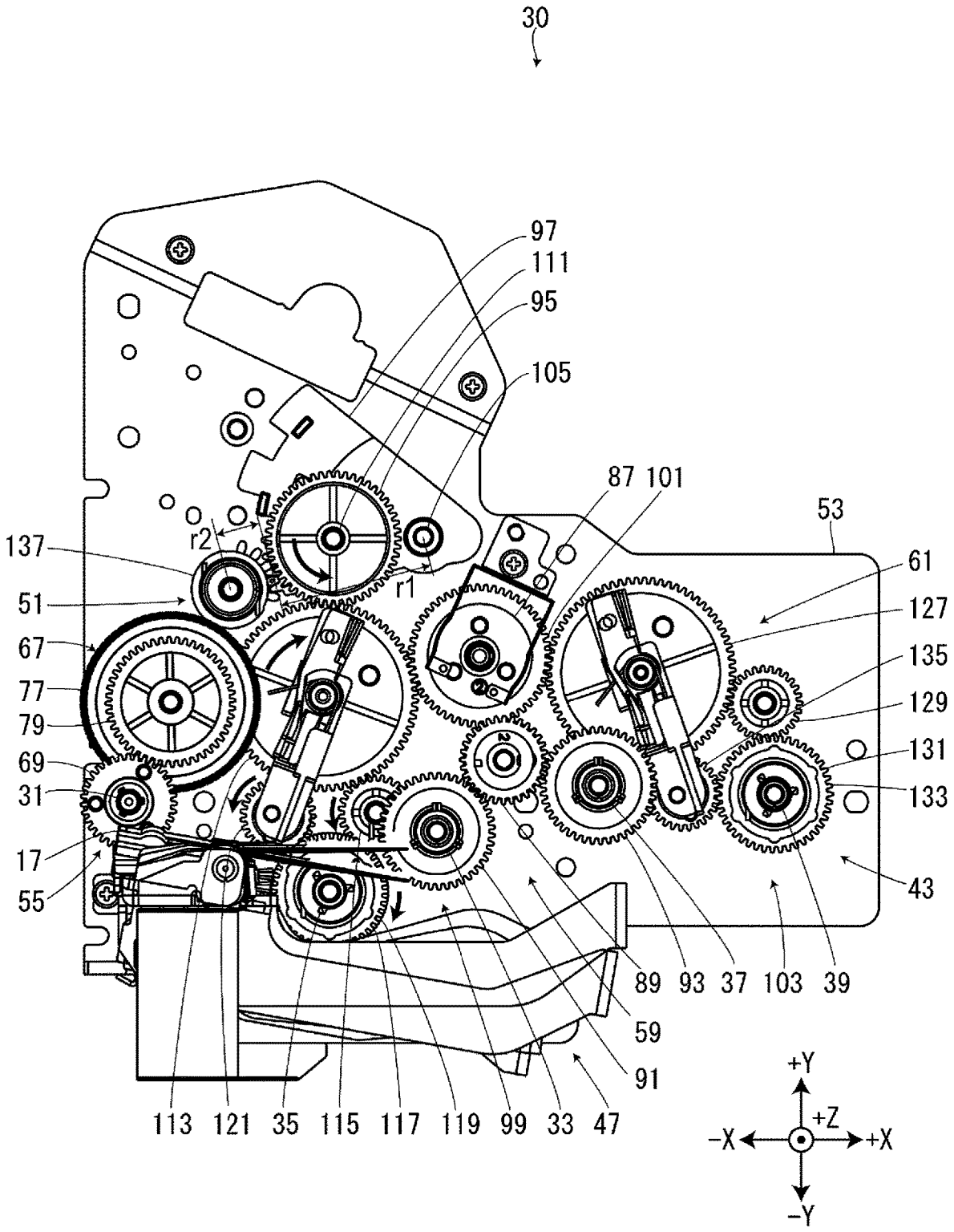
FIG. 9 is a diagram that illustrates the direction of a rotation force transmitted to each gear due to the elastic force of a second reeling slip spring when the counterclockwise rotation of the feed motor starts.

As illustrated in FIG. 6, during the clockwise rotation of the feed motor 41, that is, during the reeling of the first ink ribbon 217 onto the first reeling core 209, the fourth reeling-side gear 119 rotates counterclockwise while causing the second reeling slip spring 125 to deform elastically in such a way as to slip with respect to the first reeling rotor 35. The second reeling slip spring 125 remains deformed elastically until the counterclockwise rotation starts after the clockwise rotation of the feed motor 41 stops. Therefore, as illustrated in FIG. 9, when the counterclockwise rotation of the feed motor 41 starts, the elastic force of the second reeling slip spring 125 is transmitted to the first reeling-side gear 113 as a force for clockwise rotation. The force for causing the first reeling-side gear 113 to rotate clockwise acts as a force that impedes the disengagement of the clutch gear 95 from the first reeling-side gear 113, that is, as a force that impedes the turning of the gear supporting member 97 from the mesh position to the non-mesh position. The force that impedes the turning of the gear supporting member 97 from the mesh position to the non-mesh position will be hereinafter referred to as a clutch impeding force. In FIG. 9, the arrow indicates the direction of a rotation force transmitted to each gear due to the elastic force of the second reeling slip spring 125 when the counterclockwise rotation of the feed motor 41 starts.

Unlike the present embodiment, in a configuration in which the ribbon reeling mechanism 30 does not include the clutch drive mechanism 51, at the point in time immediately after the feed motor 41 starts rotating counterclockwise, that is, at the point in time immediately after the rewinding of the first ink ribbon 217 onto the first unreeling core 207 starts, the gear supporting member 97 is unable to turn from the mesh position to the non-mesh position due to a clutch impeding force and therefore remains located at the mesh position. That is, the clutch gear 95 has not become disengaged from the first reeling-side gear 113 yet and thus remains in mesh with the first reeling-side gear 113. Therefore, the rotation of the feed motor 41 is transmitted to the fourth reeling-side gear 119, and the fourth reeling-side gear 119 rotates clockwise. When the fourth reeling-side gear 119 rotates clockwise to some extent, for example, by 30°, the elastic deformation of the second reeling slip spring 125 is removed. As a result, the clutch impeding force caused by the elastic force of the second reeling slip spring 125 loses its magnitude. Therefore, the gear supporting member 97 turns from the mesh position to the non-mesh position, and the clutch gear 95 becomes disengaged from the first reeling-side gear 113.

In other words, the elastic deformation of the second reeling slip spring 125 is not removed until the fourth reeling-side gear 119 rotates clockwise to some extent due to the transmission of the rotation of the feed motor 41 to the fourth reeling-side gear 119 after the counterclockwise rotation of the feed motor 41 starts. For this reason, during a time period from the start of the counterclockwise rotation of the feed motor 41 to the clockwise rotation of the fourth reeling-side gear 119 to some extent, the first ink ribbon 217 is rewound under excessive back tension caused by the elastic force of the second reeling slip spring 125. If the first ink ribbon 217 is rewound under excessive back tension, there is a risk that the first ink ribbon 217 might get wrinkled because of, for example, the tilting of a ribbon guide configured to guide the feeding of the first ink ribbon 217 between the first unreeling core 207 and the first reeling core 209. Consequently, a print wrinkle might be formed in a print image on the first tape 213 when printing is performed after the rewinding of the first ink ribbon 217.

By contrast, since the tape printer 1 according to the present embodiment is equipped with the clutch drive mechanism 51, upon the start of the counterclockwise rotation of the feed motor 41, the clutch gear 95 becomes disengaged from the first reeling-side gear 113 without waiting for the fourth reeling-side gear 119 to rotate clockwise to some extent. The disengagement of the clutch gear 95 from the first reeling-side gear 113 enables each gear from the first reeling-side gear 113 to the fourth reeling-side gear 119 to rotate freely. Therefore, due to the elastic force of the second reeling slip spring 125, the fourth reeling-side gear 119 rotates clockwise, and the elastic deformation of the second reeling slip spring 125 is removed. Since the elastic deformation of the second reeling slip spring 125 is removed immediately upon the start of the counterclockwise rotation of the feed motor 41, the rewinding of the first ink ribbon 217 under excessive back tension does not occur. Therefore, it is possible to prevent a print wrinkle from being formed in a print image on the first tape 213 when printing is performed after the rewinding of the first ink ribbon 217. Next, the clutch drive mechanism 51 configured to move the gear supporting member 97 between the mesh position and the non-mesh position will now be explained.

Clutch Drive Mechanism

Figure 10:
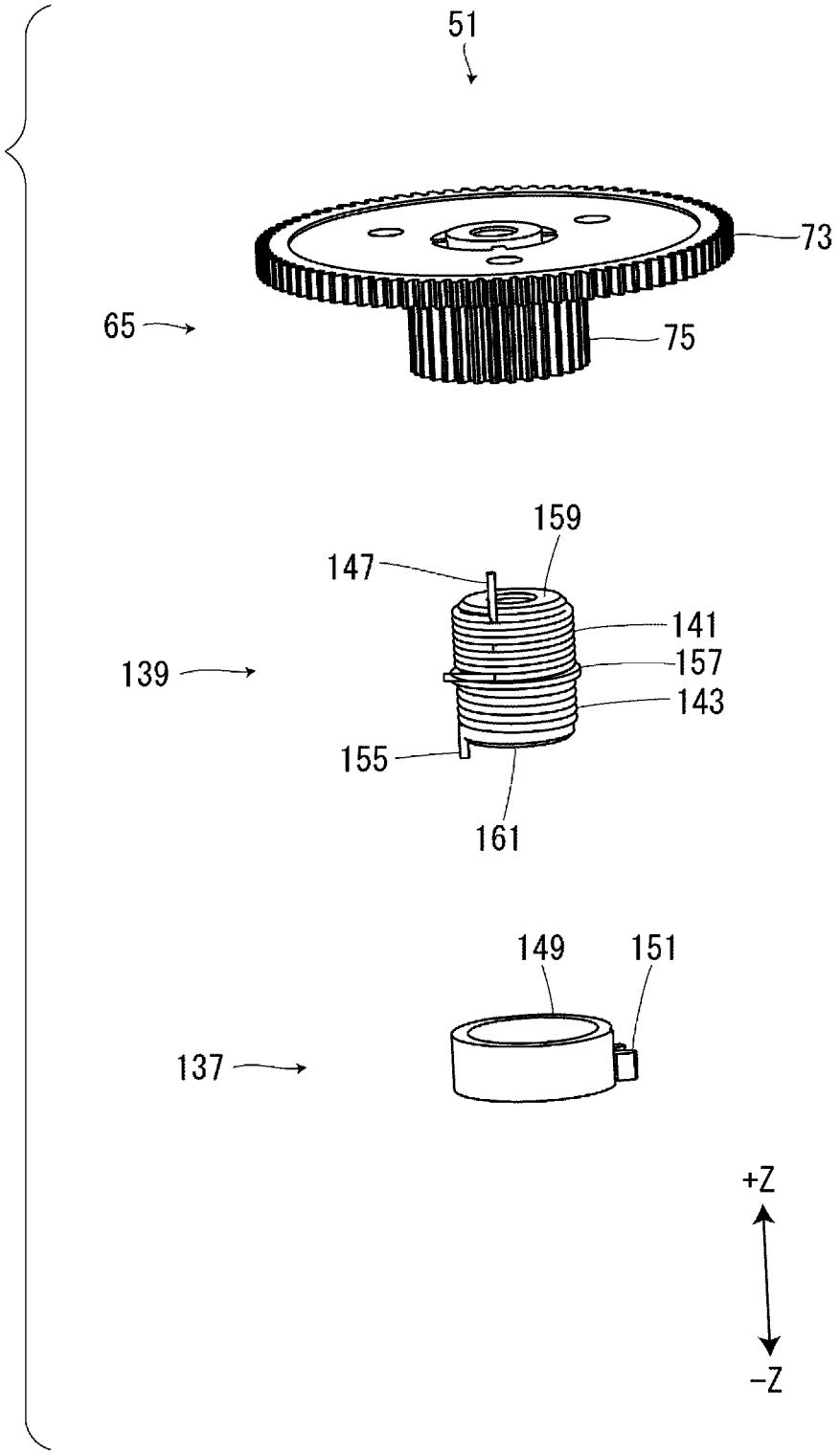
FIG. 10 is an exploded perspective view of a clutch drive mechanism.
Figure 11:
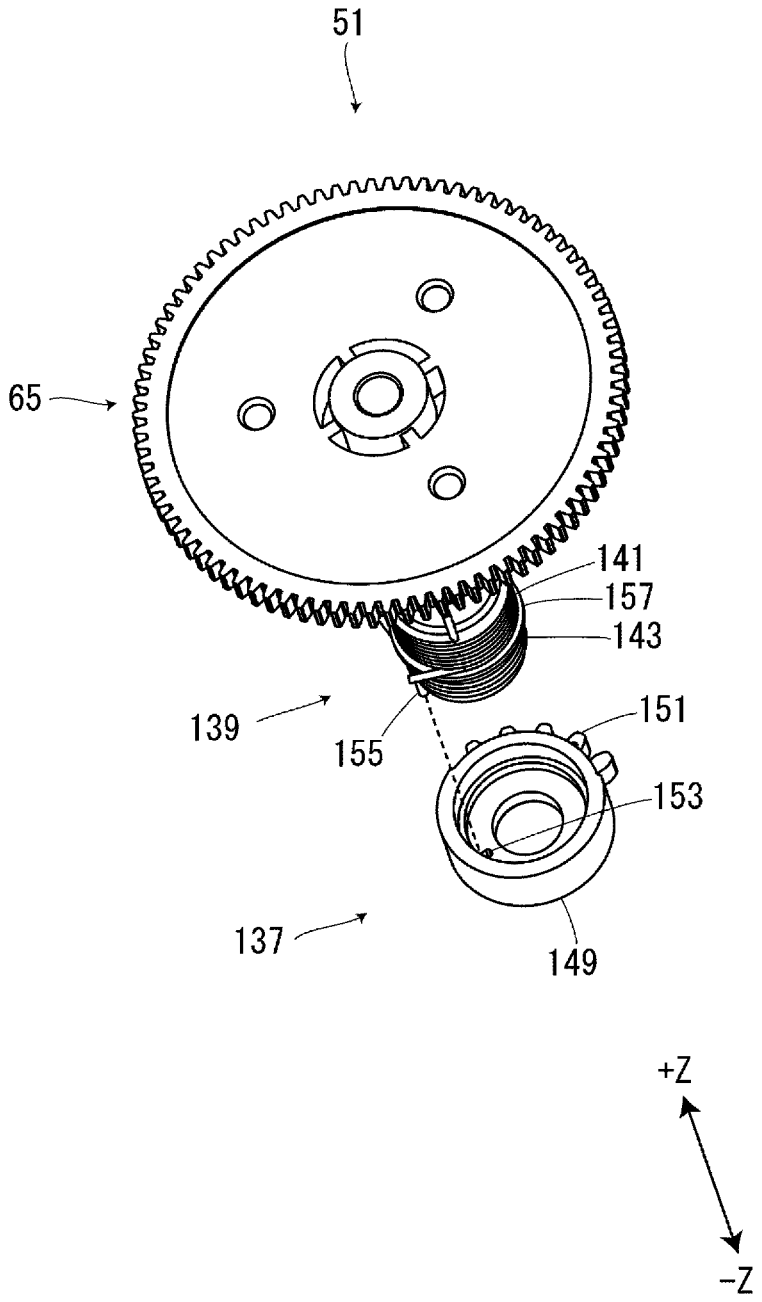
FIG. 11 is an exploded perspective view of the clutch drive mechanism, taken at an angle different from that of FIG. 10.
Figure 12:
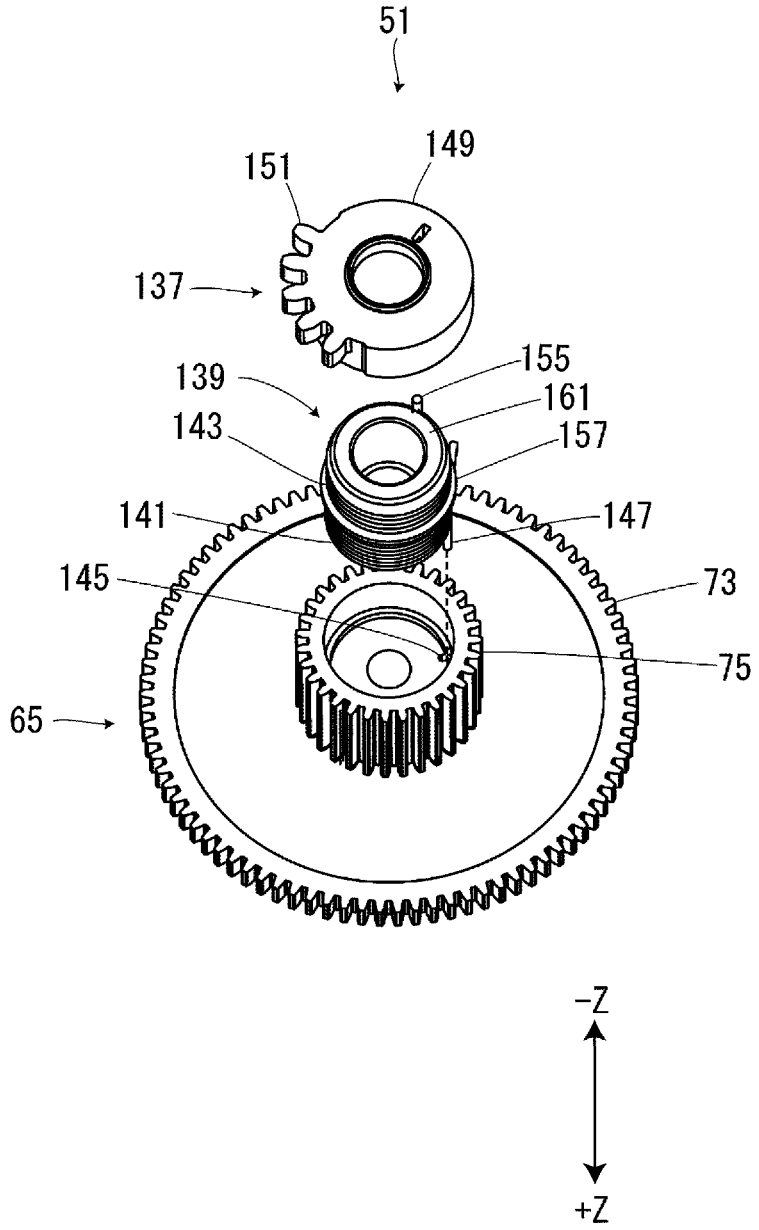
FIG. 12 is an exploded perspective view of the clutch drive mechanism, taken at an angle different from that of FIGS. 10 and 11.

As illustrated in FIGS. 10 to 12, the clutch drive mechanism 51 includes the aforementioned second feed gear 65, the aforementioned drive member 137, a clutch shaft member 139, a first clutch slip spring 141, and a second clutch slip spring 143.

As illustrated in FIG. 6, the second feed gear 65 rotates clockwise when the feed motor 41 rotates clockwise. As illustrated in FIG. 7, the second feed gear 65 rotates counterclockwise when the feed motor 41 rotates counterclockwise. A gear-side engagement recess 145 illustrated in FIG. 12 is provided in the −Z-directional face of the second feed gear 65. A first spring end portion 147, which is the +Z-directional end of the first clutch slip spring 141, is engaged with the gear-side engagement recess 145. The gear-side engagement recess 145 is provided inside the second feed smaller-diameter portion 75 having a teethed cylindrical shape and protruding from the −Z-directional face of the second feed gear 65.

The drive member 137 is able to rotate coaxially with the second feed gear 65. The drive member 137 is coupled to the second feed gear 65 via the first clutch slip spring 141, the clutch shaft member 139, and the second clutch slip spring 143. The drive member 137 is in mesh with the gear supporting member 97. The drive member 137 causes the gear supporting member 97 to turn to the mesh position by rotating clockwise. The drive member 137 causes the gear supporting member 97 to turn to the non-mesh position by rotating counterclockwise.

The drive member 137 includes a drive cylinder portion 149 and a drive-side teeth portion 151. The drive cylinder portion 149 has a substantially cylindrical shape with a bottom. A drive-side engagement recess 153 illustrated in FIG. 11 is provided in the bottom surface of the drive cylinder portion 149. A second spring end portion 155, which is the −Z-directional end of the second clutch slip spring 143, is engaged with the drive-side engagement recess 153. The drive-side teeth portion 151 is provided on a part of the circumferential surface of the drive cylinder portion 149 in the circumferential direction. The drive-side teeth portion 151 is in mesh with the support-side teeth portion 109 of the gear supporting member 97.

The clutch shaft member 139 has a substantially cylindrical shape. The clutch shaft member 139 is located between the second feed gear 65 and the drive member 137. The clutch shaft member 139 is able to rotate coaxially with the second feed gear 65 and the drive member 137. The clutch shaft member 139 has a flange portion 157 substantially at its center in the axial direction. The portion, of the clutch shaft member 139, located at the +Z-directional side with respect to the flange portion 157 is referred to as a first spring mount portion 159. The portion, of the clutch shaft member 139, located at the −Z-directional side with respect to the flange portion 157 is referred to as a second spring mount portion 161. The first spring mount portion 159 is inserted into the second feed smaller-diameter portion 75. The second spring mount portion 161 is inserted into the drive cylinder portion 149.

The first clutch slip spring 141 couples the second feed gear 65 and the clutch shaft member 139 to each other. Specifically, the first clutch slip spring 141 is a torsion coil spring, and is externally fitted on the first spring mount portion 159, with the first spring end portion 147 engaged with the gear-side engagement recess 145. When the second feed gear 65 rotates clockwise, the first clutch slip spring 141 deforms elastically in such a way as to slip with respect to the clutch shaft member 139, thereby limiting a torque transmitted from the second feed gear 65 to the clutch shaft member 139 to a first torque.

The second clutch slip spring 143 couples the clutch shaft member 139 and the drive member 137 to each other. Specifically, the second clutch slip spring 143 is a torsion coil spring, and is externally fitted on the second spring mount portion 161, with the second spring end portion 155 engaged with the drive-side engagement recess 153. When the clutch shaft member 139 rotates counterclockwise, the second clutch slip spring 143 deforms elastically in such a way as to slip with respect to the clutch shaft member 139, thereby limiting a torque transmitted from the clutch shaft member 139 to the drive member 137 to a second torque.

Figure 14:
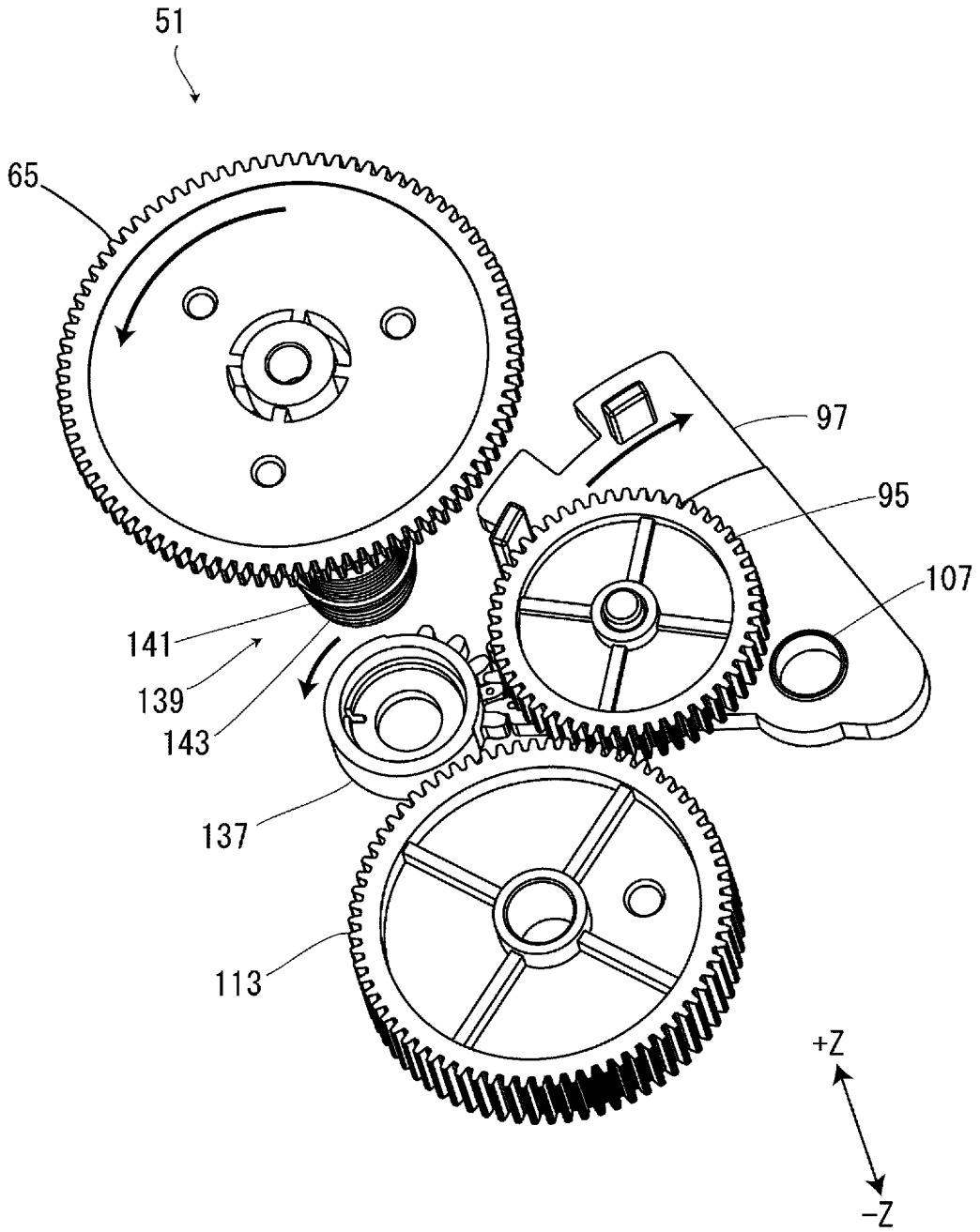
FIG. 14 is a diagram that illustrates the motion of each component of the clutch drive mechanism when the feed motor rotates counterclockwise.

With reference to FIGS. 13 and 14, the operation of each component of the clutch drive mechanism 51 when the feed motor 41 rotates clockwise and the operation of each component of the clutch drive mechanism 51 when the feed motor 41 rotates counterclockwise will now be explained. In FIG. 13, the arrows indicate the directions in which the second feed gear 65, the drive member 137, and the gear supporting member 97 rotate respectively when the feed motor 41 rotates clockwise. In FIG. 14, the arrows indicate the directions in which the second feed gear 65, the drive member 137, and the gear supporting member 97 rotate respectively when the feed motor 41 rotates counterclockwise.

As illustrated in FIG. 13, since the second feed gear 65 rotates clockwise when the feed motor 41 rotates clockwise, the drive member 137 coupled to the second feed gear 65 also rotates clockwise. With this operation, the clutch drive mechanism 51 causes the gear supporting member 97, which is in mesh with the drive member 137, to turn counterclockwise to the mesh position. As a result, it is possible to bring the clutch gear 95 supported by the gear supporting member 97 into meshing engagement with the first reeling-side gear 113. The drive member 137 rotates clockwise until the gear supporting member 97 turns to arrive at the mesh position, that is, until the clutch gear 95 is brought into meshing engagement with the first reeling-side gear 113. The drive member 137 stops rotating when the gear supporting member 97 turns to arrive at the mesh position. The second feed gear 65 keeps rotating clockwise even after the gear supporting member 97 turns to arrive at the mesh position, by the slipping of the first clutch slip spring 141 with respect to the clutch shaft member 139.

As illustrated in FIG. 14, since the second feed gear 65 rotates counterclockwise when the feed motor 41 rotates counterclockwise, the drive member 137 coupled to the second feed gear 65 also rotates counterclockwise. With this operation, the clutch drive mechanism 51 causes the gear supporting member 97, which is in mesh with the drive member 137, to turn clockwise to the non-mesh position. As a result, it is possible to disengage the clutch gear 95 supported by the gear supporting member 97 from the first reeling-side gear 113. The drive member 137 rotates counterclockwise until the gear supporting member 97 turns to arrive at the non-mesh position, that is, until the inner surface of the position-restricting concave portion provided in the gear supporting member 97 collides with the position-restricting convex portion as described earlier. The drive member 137 stops rotating when the gear supporting member 97 turns to arrive at the non-mesh position. The second feed gear 65 keeps rotating counterclockwise even after the gear supporting member 97 turns to arrive at the non-mesh position, by the slipping of the second clutch slip spring 143 with respect to the clutch shaft member 139. For example, if the amount of rewinding of the first ink ribbon 217 is 6 mm, the gear supporting member 97 turns to arrive at the non-mesh position while the first 2 mm-part of it is rewound, and the second clutch slip spring 143 slips with respect to the clutch shaft member 139 while the rest, 4 mm-part of it, is rewound.

As illustrated in FIG. 9, the radius of rotation r1 of the gear supporting member 97 is larger than the radius of rotation r2 of the drive member 137. Therefore, it is possible to make the torque for rotating the gear supporting member 97 larger than the torque for rotating the drive member 137. Therefore, even if the torque for rotating the drive member 137 is not so large, it is possible to apply, to the gear supporting member 97, the torque that is needed for disengaging the clutch gear 95 from the first reeling-side gear 113. The radius of rotation r1 of the gear supporting member 97 is preferably at least twice as large as the radius of rotation r2 of the drive member 137. More preferably, the radius of rotation r1 of the gear supporting member 97 is at least three times as large as the radius of rotation r2 of the drive member 137. In the present embodiment, the radius of rotation r1 of the gear supporting member 97 is approximately four times as large as the radius of rotation r2 of the drive member 137. The radius of rotation r1 of the gear supporting member 97 means the length from the center of rotation of the gear supporting member 97 to the mesh point of the gear supporting member 97 and the drive member 137 The radius of rotation r2 of the drive member 137 means the length from the center of rotation of the drive member 137 to the mesh point of the drive member 137 and the gear supporting member 97.

When the feed motor 41 rotates clockwise, that is, when the first tape 213 is fed forward and when the first ink ribbon 217 is reeled onto the first reeling core 209, the burden of the feed motor 41 is heavy because the feed amount of the first tape 213 and the first ink ribbon 217 is large and because the feed speed of them is high. Therefore, in order to lighten the load of the clutch drive mechanism 51 on the feed motor 41, it is required to transmit a comparatively small torque from the second feed gear 65 to the drive member 137. On the other hand, when the feed motor 41 rotates counterclockwise, that is, when the first tape 213 is fed backward and when the first ink ribbon 217 is rewound onto the first unreeling core 207, it is required to transmit a comparatively large torque from the second feed gear 65 to the drive member 137 in order to cause the gear supporting member 97 to turn from the mesh position to the non-mesh position against the above-described clutch impeding force caused by the elastic force of the second reeling slip spring 125.

In order to satisfy these demands, the first torque transmitted by the first clutch slip spring 141 when the feed motor 41 rotates clockwise is smaller than the second torque transmitted by the second clutch slip spring 143 when the feed motor 41 rotates counterclockwise. Because of this torque relationship, a comparatively small torque is transmitted from the second feed gear 65 to the drive member 137 when the feed motor 41 rotates clockwise. Therefore, it is possible to lighten the load applied to the feed motor 41 and thus prevent troubles such as stepping out from occurring on the feed motor 41.

On the other hand, a comparatively large torque is transmitted from the second feed gear 65 to the drive member 137 when the feed motor 41 rotates counterclockwise. Therefore, it is possible to rotate the drive member 137 with the torque required for disengaging the clutch gear 95 from the first reeling-side gear 113. Since the first clutch slip spring 141 deforms elastically in such a way as to tighten with respect to the clutch shaft member 139, it is possible to prevent the transmission of a torque from the second feed gear 65 to the drive member 137 from being impaired by the first clutch slip spring 141.

As explained above, the ribbon reeling mechanism 30 according to the present embodiment makes it possible to forcibly disengage the clutch gear 95 from the first reeling-side gear 113 because the clutch drive mechanism 51 causes the gear supporting member 97 to turn from the mesh position to the non-mesh position against the clutch impeding force when the feed motor 41 rotates counterclockwise. This enables each of the gears that make up the reeling-side gear train 61 to rotate freely and removes the elastic deformation of the second reeling slip spring 125. Therefore, it is possible to prevent the first ink ribbon 217 from being rewound while being tensioned excessively by the elastic force of the second reeling slip spring 125. Even after the removal of the elastic deformation of the second reeling slip spring 125, the first ink ribbon 217 remains tensioned slightly due to the rotation load, etc. of each of the gears that make up the first reeling-side gear train 99. Therefore, it is possible to rewind the first ink ribbon 217 onto the first unreeling core 207 properly.

In the above example, a case where a tape cartridge 201 containing a wide first ink ribbon 217 is attached has been described. However, the ribbon reeling mechanism 30 is able to produce the above operational effects not only in the above case but also in other cases. Specifically, in all of the following cases, the ribbon reeling mechanism 30 is able to produce the same operational effects as those of the case where a tape cartridge 201 containing a wide first ink ribbon 217 is attached: a case where a tape cartridge 201 containing a narrow first ink ribbon 217 is attached; a case where a ribbon cartridge 301 containing a wide second ink ribbon 317 is attached: a case where a ribbon cartridge 301 containing a narrow second ink ribbon 317 is attached. In a case where a tape cartridge 201 containing a narrow first ink ribbon 217 is attached, the elastic force of the first reeling slip spring 123 acts as the clutch impeding force. In a case where a ribbon cartridge 301 containing a wide second ink ribbon 317 is attached, the elastic force of the fourth reeling slip spring acts as the clutch impeding force. In a case where a ribbon cartridge 301 containing a narrow second ink ribbon 317 is attached, the elastic force of the third reeling slip spring acts as the clutch impeding force. Despite the impediment, the ribbon reeling mechanism 30 according to the present embodiment makes it possible to forcibly disengage the clutch gear 95 from the first reeling-side gear 113 because the clutch drive mechanism 51 causes the gear supporting member 97 to turn from the mesh position to the non-mesh position against the clutch impeding force when the feed motor 41 rotates counterclockwise.

As explained earlier, in a case where a tape cartridge 201 containing a wide first ink ribbon 217 is attached, the torque for reeling the first ink ribbon 217 is larger, as compared with a case where a tape cartridge 201 containing a narrow first ink ribbon 217 is attached. Therefore, in a case where a tape cartridge 201 containing a wide first ink ribbon 217 is attached, the clutch impeding force is larger, as compared with a case where a tape cartridge 201 containing a narrow first ink ribbon 217 is attached. For this reason, the ribbon reeling mechanism 30 according to the present embodiment is especially useful in a case where a tape cartridge 201 containing a wide first ink ribbon 217 is attached. Similarly, in a case where a ribbon cartridge 301 containing a wide second ink ribbon 317 is attached, the torque for reeling the second ink ribbon 317 is larger, as compared with a case where a ribbon cartridge 301 containing a narrow second ink ribbon 317 is attached. Therefore, in a case where a ribbon cartridge 301 containing a wide second ink ribbon 317 is attached, the clutch impeding force is larger, as compared with a case where a ribbon cartridge 301 containing a narrow second ink ribbon 317 is attached. For this reason, the ribbon reeling mechanism 30 according to the present embodiment is especially useful in a case where a ribbon cartridge 301 containing a wide second ink ribbon 317 is attached.

Other Modification Examples

The scope of the present disclosure is not limited to the embodiments described above. Needless to mention, various kinds of configuration can be adopted within a range of not departing from the gist of the present disclosure. For example, in addition to the foregoing examples, the embodiments described above may be modified as follows. The embodiments and the modification examples may be combined.

The configuration according to the present disclosure is not limited to a configuration in which the gear supporting member 97 is able to turn between the mesh position and the non-mesh position. It is sufficient as long as the gear supporting member 97 is able to move between the mesh position and the non-mesh position. For example, the gear supporting member 97 may be configured to be able to move between the mesh position and the non-mesh position by parallel translation. The configuration according to the present disclosure is not limited to a configuration in which the gear supporting member 97 is in mesh with the drive member 137. It is sufficient as long as the gear supporting member 97 is engaged with the drive member 137.

The configuration according to the present disclosure is not limited to a configuration in which the drive member 137 is coupled via the clutch shaft member 139 to a gear that is one of gears that make up the feed gear train 55, for example, the second feed gear 65. The drive member 137 may be coupled to a gear other than the gears that make up the feed gear train 55. The configuration according to the present disclosure is not limited to a configuration in which the drive member 137 is driven by being coupled via the clutch shaft member 139 to a gear. For example, the drive member 137 may be driven by being in mesh with a gear. The drive source for driving the drive member 137 is not limited to the feed motor 41. For example, the drive member 137 may be driven by another motor that is not the feed motor 41.

The configuration according to the present disclosure is not limited to a configuration in which the ribbon reeling mechanism 30 is equipped with the first reeling slip spring 123 and the second reeling slip spring 125 for the first reeling rotor 35 in order to switch the torque for reeling the first ink ribbon 217. The ribbon reeling mechanism 30 may be equipped with a single reeling slip spring for the first reeling rotor 35. Similarly, the configuration according to the present disclosure is not limited to a configuration in which the ribbon reeling mechanism 30 is equipped with the third reeling slip spring and the fourth reeling slip spring for the second reeling rotor 39 in order to switch the torque for reeling the second ink ribbon 317. The ribbon reeling mechanism 30 may be equipped with a single reeling slip spring for the second reeling rotor 39.

The configuration according to the present disclosure is not limited to a configuration in which either the tape cartridge 201 or the ribbon cartridge 301 is selectively attached to the cartridge attachment portion 11. The tape cartridge 201 only may be attachable, or the ribbon cartridge 301 only may be attachable, instead of selectable attachment.

Additional Description

The following is an additional description about a ribbon reeling mechanism and a tape printing apparatus.

A ribbon reeling mechanism includes: an unreeling rotor engaged with an unreeling core around which an ink ribbon is wound; a reeling rotor engaged with a reeling core onto which the ink ribbon reeled out from the unreeling core is reeled; a feed motor that is rotatable in a first rotation direction and a second rotation direction, the second rotation direction being opposite of the first rotation direction; a reeling-side gear train that includes a first reeling-side gear and a clutch gear, the clutch gear being configured to move between a position at which the clutch gear is in mesh with the first reeling-side gear and a position at which the clutch gear is not in mesh with the first reeling-side gear, the reeling-side gear train being configured to transmit rotation of the feed motor to the reeling rotor so as to reel the ink ribbon onto the reeling core by meshing engagement of the clutch gear with the first reeling-side gear when the feed motor rotates in the first rotation direction, the reeling-side gear train being configured not to transmit the rotation of the feed motor to the reeling rotor by disengagement of the clutch gear from the first reeling-side gear when the feed motor rotates in the second rotation direction; an unreeling-side gear train that does not transmit the rotation of the feed motor to the unreeling rotor when the feed motor rotates in the first rotation direction and transmits the rotation of the feed motor to the unreeling rotor so as to rewind the ink ribbon onto the unreeling core when the feed motor rotates in the second rotation direction; a gear supporting member that supports the clutch gear rotatably and is configured to move between a mesh position at which the clutch gear supported by the gear supporting member is in mesh with the first reeling-side gear and a non-mesh position at which the clutch gear supported by the gear supporting member is not in mesh with the first reeling-side gear; a clutch impeding spring that causes a clutch impeding force of impeding movement from the mesh position to the non-mesh position to act on the gear supporting member when the feed motor starts rotating in the second rotation direction; a drive member engaged with the gear supporting member; and a clutch drive mechanism that causes the gear supporting member to move to the non-mesh position against the clutch impeding force when the feed motor rotates in the second rotation direction.

With this configuration, it is possible to forcibly disengage the clutch gear from the first reeling-side gear because the clutch drive mechanism causes the gear supporting member to move to the non-mesh position when the feed motor rotates in the second rotation direction. This enables each of the gears that make up the reeling-side gear train to rotate freely and removes the elastic deformation of the reeling slip spring. Therefore, it is possible to prevent the ink ribbon from being rewound while being tensioned excessively by the elastic force of the reeling slip spring.

The first ink ribbon 217 is an example of the "ink ribbon". The second ink ribbon 317 is another example of the "ink ribbon". The first unreeling core 207 is an example of the "unreeling core". The second unreeling core 307 is another example of the "unreeling core". The first unreeling rotor 33 is an example of the "unreeling rotor". The second unreeling rotor 37 is another example of the "unreeling rotor". The first reeling core 209 is an example of the "reeling core". The second reeling core 309 is another example of the "reeling core". The first reeling rotor 35 is an example of the "reeling rotor". The second reeling rotor 39 is another example of the "reeling rotor". The clockwise direction is an example of the "first rotation direction". The counterclockwise direction is an example of the "second rotation direction". The first reeling slip spring 123 is an example of the "clutch impeding spring". The second reeling slip spring 125 is another example of the "clutch impeding spring". The third reeling slip spring is another example of the "clutch impeding spring". The fourth reeling slip spring is still another example of the "clutch impeding spring".

When the ribbon reeling mechanism is configured as stated above, the gear supporting member may include a support-side teeth portion, the drive member may include a drive-side teeth portion that is in mesh with the support-side teeth portion, and the drive member may cause the gear supporting member to turn to the mesh position by rotating in a first drive direction when the feed motor rotates in the first rotation direction, and may cause the gear supporting member to turn to the non-mesh position by rotating in a second drive direction, which is opposite of the first drive direction, when the feed motor rotates in the second rotation direction.

With this configuration, by the rotation of the drive member in the first drive direction, it is possible to cause the gear supporting member to turn to the mesh position and bring the clutch gear supported by the gear supporting member into meshing engagement with the first reeling-side gear. Moreover, by the rotation of the drive member in the second drive direction, it is possible to cause the gear supporting member to turn to the non-mesh position and disengage the clutch gear supported by the gear supporting member from the first reeling-side gear.

The clockwise direction is an example of the "first drive direction". The counterclockwise direction is an example of the "second drive direction". The first drive direction may be the same as the first rotation direction. The first drive direction may be different from the first rotation direction. Similarly, the second drive direction may be the same as the second rotation direction or different therefrom.

When the ribbon reeling mechanism is configured as stated above, a radius of rotation of the gear supporting member may be larger than a radius of rotation of the drive member.

With this configuration, it is possible to make the torque for rotating the gear supporting member larger than the torque for rotating the drive member. Therefore, even if the torque for rotating the drive member is not so large, it is possible to apply, to the gear supporting member, the torque that is needed for disengaging the clutch gear from the first reeling-side gear.

When the ribbon reeling mechanism is configured as stated above, the clutch drive mechanism may include: an input gear that rotates in the first drive direction when the feed motor rotates in the first rotation direction and rotates in the second drive direction when the feed motor rotates in the second rotation direction; a clutch shaft member provided between the input gear and the drive member coaxially with the input gear and the drive member; a first clutch slip spring that couples the input gear to the clutch shaft member and limits a torque transmitted from the input gear to the clutch shaft member by slipping with respect to the clutch shaft member when the input gear rotates in the first drive direction; and a second clutch slip spring that couples the clutch shaft member to the drive member and limits a torque transmitted from the clutch shaft member to the drive member by slipping with respect to the clutch shaft member when the clutch shaft member rotates in the second drive direction.

In this configuration, the first clutch slip spring slips with respect to the clutch shaft member when the input gear rotates in the first drive direction. Therefore, the input gear keeps rotating in the first drive direction even after the gear supporting member turns to the mesh position. In addition, the second clutch slip spring slips with respect to the clutch shaft member when the clutch shaft member rotates in the second drive direction. Therefore, the input gear keeps rotating in the second drive direction even after the gear supporting member turns to the non-mesh position.

The second feed gear 65 is an example of the "input gear".

When the ribbon reeling mechanism is configured as stated above, the first clutch slip spring may limit the torque transmitted from the input gear to the clutch shaft member to a first torque, and the second clutch slip spring may limit the torque transmitted from the clutch shaft member to the drive member to a second torque that is larger than the first torque.

Since a comparatively small torque is transmitted from the input gear to the drive member when the feed motor rotates in the first rotation direction, this configuration makes it possible to lighten the load applied to the feed motor. On the other hand, a comparatively large torque is transmitted from the input gear to the drive member when the feed motor rotates in the second rotation direction. Therefore, it is possible to rotate the drive member with the torque required for disengaging the clutch gear from the first reeling-side gear.

The ribbon reeling mechanism, when configured as stated above, may further include: a roller rotor engaged with a feed roller that feeds the ink ribbon between the unreeling core and the reeling core; and a feed gear train that transmits the rotation of the feed motor to the roller rotor, wherein the input gear may be included in the feed gear train.

With this configuration, it is possible to rotate the drive member by utilizing the rotation of the input gear included in the feed gear train.

The first platen roller 205 is an example of the "feed roller". The second platen roller 305 is another example of the "feed roller". The platen rotor 31 is an example of the "roller rotor".

A tape printing apparatus includes: an unreeling rotor engaged with an unreeling core around which an ink ribbon is wound; a reeling rotor engaged with a reeling core onto which the ink ribbon reeled out from the unreeling core is reeled; a feed motor that is rotatable in a first rotation direction and a second rotation direction, the second rotation direction being opposite of the first rotation direction; a reeling-side gear train that includes a first reeling-side gear and a clutch gear, the clutch gear being configured to move between a position at which the clutch gear is in mesh with the first reeling-side gear and a position at which the clutch gear is not in mesh with the first reeling-side gear, the reeling-side gear train being configured to transmit rotation of the feed motor to the reeling rotor so as to reel the ink ribbon onto the reeling core by meshing engagement of the clutch gear with the first reeling-side gear when the feed motor rotates in the first rotation direction, the reeling-side gear train being configured not to transmit the rotation of the feed motor to the reeling rotor by disengagement of the clutch gear from the first reeling-side gear when the feed motor rotates in the second rotation direction; an unreeling-side gear train that does not transmit the rotation of the feed motor to the unreeling rotor when the feed motor rotates in the first rotation direction and transmits the rotation of the feed motor to the unreeling rotor so as to rewind the ink ribbon onto the unreeling core when the feed motor rotates in the second rotation direction; a gear supporting member that supports the clutch gear rotatably and is configured to move between a mesh position at which the clutch gear supported by the gear supporting member is in mesh with the first reeling-side gear and a non-mesh position at which the clutch gear supported by the gear supporting member is not in mesh with the first reeling-side gear; a clutch impeding spring that causes a clutch impeding force of impeding movement from the mesh position to the non-mesh position to act on the gear supporting member when the feed motor starts rotating in the second rotation direction; a drive member engaged with the gear supporting member; a clutch drive mechanism that causes the gear supporting member to move to the non-mesh position against the clutch impeding force when the feed motor rotates in the second rotation direction; and a thermal head that performs printing on a tape using the ink ribbon.

With this configuration, it is possible to forcibly disengage the clutch gear from the first reeling-side gear because the clutch drive mechanism causes the gear supporting member to move to the non-mesh position when the feed motor rotates in the second rotation direction. This enables each of the gears that make up the reeling-side gear train to rotate freely and removes the elastic deformation of the reeling slip spring. Therefore, it is possible to prevent the ink ribbon from being rewound while being tensioned excessively by the elastic force of the reeling slip spring.

The first tape 213 is an example of the "tape". The second tape 313 is another example of the "tape".

What is claimed is:

1. A ribbon reeling mechanism, comprising:

an unreeling rotor engaged with an unreeling core around which an ink ribbon is wound;

a reeling rotor engaged with a reeling core onto which the ink ribbon reeled out from the unreeling core is reeled;

a feed motor that is rotatable in a first rotation direction and a second rotation direction, the second rotation direction being opposite of the first rotation direction;

a reeling-side gear train that includes a first reeling-side gear and a clutch gear, the clutch gear being configured to move between a position at which the clutch gear is in mesh with the first reeling-side gear and a position at which the clutch gear is not in mesh with the first reeling-side gear, the reeling-side gear train being configured to transmit rotation of the feed motor to the reeling rotor so as to reel the ink ribbon onto the reeling core by meshing engagement of the clutch gear with the first reeling-side gear when the feed motor rotates in the first rotation direction, the reeling-side gear train being configured not to transmit the rotation of the feed motor to the reeling rotor by disengagement of the clutch gear from the first reeling-side gear when the feed motor rotates in the second rotation direction;

an unreeling-side gear train that does not transmit the rotation of the feed motor to the unreeling rotor when the feed motor rotates in the first rotation direction and transmits the rotation of the feed motor to the unreeling rotor so as to rewind the ink ribbon onto the unreeling core when the feed motor rotates in the second rotation direction;

a gear supporting member that supports the clutch gear rotatably and is configured to move between a mesh position at which the clutch gear supported by the gear supporting member is in mesh with the first reeling-side gear and a non-mesh position at which the clutch gear supported by the gear supporting member is not in mesh with the first reeling-side gear;

a clutch impeding spring that causes a clutch impeding force of impeding movement from the mesh position to the non-mesh position to act on the gear supporting member when the feed motor starts rotating in the second rotation direction;

a drive member engaged with the gear supporting member; and a clutch drive mechanism that causes the gear supporting member to move to the non-mesh position against the clutch impeding force when the feed motor rotates in the second rotation direction.

2. The ribbon reeling mechanism according to claim 1, wherein the gear supporting member includes a support-side teeth portion, the drive member includes a drive-side teeth portion that is in mesh with the support-side teeth portion, and the drive member causes the gear supporting member to turn to the mesh position by rotating in a first drive direction when the feed motor rotates in the first rotation direction, and causes the gear supporting member to turn to the non-mesh position by rotating in a second drive direction, which is opposite of the first drive direction, when the feed motor rotates in the second rotation direction.

3. The ribbon reeling mechanism according to claim 2, wherein a radius of rotation of the gear supporting member is larger than a radius of rotation of the drive member.

4. The ribbon reeling mechanism according to claim 2, wherein the clutch drive mechanism includes:

an input gear that rotates in the first drive direction when the feed motor rotates in the first rotation direction and rotates in the second drive direction when the feed motor rotates in the second rotation direction;

a clutch shaft member provided between the input gear and the drive member coaxially with the input gear and the drive member;

a first clutch slip spring that couples the input gear to the clutch shaft member and limits a torque transmitted from the input gear to the clutch shaft member by slipping with respect to the clutch shaft member when the input gear rotates in the first drive direction; and a second clutch slip spring that couples the clutch shaft member to the drive member and limits a torque transmitted from the clutch shaft member to the drive member by slipping with respect to the clutch shaft member when the clutch shaft member rotates in the second drive direction.

5. The ribbon reeling mechanism according to claim 4, wherein the first clutch slip spring limits the torque transmitted from the input gear to the clutch shaft member to a first torque, and the second clutch slip spring limits the torque transmitted from the clutch shaft member to the drive member to a second torque that is larger than the first torque.

6. The ribbon reeling mechanism according to claim 4, further comprising:

a roller rotor engaged with a feed roller that feeds the ink ribbon between the unreeling core and the reeling core; and a feed gear train that transmits the rotation of the feed motor to the roller rotor, wherein the input gear is included in the feed gear train.

7. A tape printing apparatus, comprising:

an unreeling rotor engaged with an unreeling core around which an ink ribbon is wound;

a reeling rotor engaged with a reeling core onto which the ink ribbon reeled out from the unreeling core is reeled;

a feed motor that is rotatable in a first rotation direction and a second rotation direction, the second rotation direction being opposite of the first rotation direction;

a reeling-side gear train that includes a first reeling-side gear and a clutch gear, the clutch gear being configured to move between a position at which the clutch gear is in mesh with the first reeling-side gear and a position at which the clutch gear is not in mesh with the first reeling-side gear, the reeling-side gear train being configured to transmit rotation of the feed motor to the reeling rotor so as to reel the ink ribbon onto the reeling core by meshing engagement of the clutch gear with the first reeling-side gear when the feed motor rotates in the first rotation direction, the reeling-side gear train being configured not to transmit the rotation of the feed motor to the reeling rotor by disengagement of the clutch gear from the first reeling-side gear when the feed motor rotates in the second rotation direction;

an unreeling-side gear train that does not transmit the rotation of the feed motor to the unreeling rotor when the feed motor rotates in the first rotation direction and transmits the rotation of the feed motor to the unreeling rotor so as to rewind the ink ribbon onto the unreeling core when the feed motor rotates in the second rotation direction;

a gear supporting member that supports the clutch gear rotatably and is configured to move between a mesh position at which the clutch gear supported by the gear supporting member is in mesh with the first reeling-side gear and a non-mesh position at which the clutch gear supported by the gear supporting member is not in mesh with the first reeling-side gear;

a clutch impeding spring that causes a clutch impeding force of impeding movement from the mesh position to the non-mesh position to act on the gear supporting member when the feed motor starts rotating in the second rotation direction;

a drive member engaged with the gear supporting member;

a clutch drive mechanism that causes the gear supporting member to move to the non-mesh position against the clutch impeding force when the feed motor rotates in the second rotation direction; and a thermal head that performs printing on a tape using the ink ribbon.

* * * * *